US008418677B2

(12) United States Patent
Okamoto

(10) Patent No.: US 8,418,677 B2
(45) Date of Patent: Apr. 16, 2013

(54) HIGH PRESSURE FUEL PUMP CONTROL SYSTEM FOR INTERNAL COMBUSTION ENGINE

(75) Inventor: Takashi Okamoto, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 304 days.

(21) Appl. No.: 13/030,008

(22) Filed: Feb. 17, 2011

(65) Prior Publication Data

US 2011/0232610 A1 Sep. 29, 2011

(30) Foreign Application Priority Data

Mar. 25, 2010 (JP) ..... 2010-069110

(51) Int. Cl.
*F02M 37/08* (2006.01)

(52) U.S. Cl.
USPC ..... 123/512; 123/511; 123/446; 123/447; 123/500; 123/501; 123/456; 123/457; 123/458; 417/295; 417/307; 417/309; 417/311

(58) Field of Classification Search ..... 123/446, 123/447, 456–458, 500, 501, 506, 510–511; 417/295, 307, 309, 311
See application file for complete search history.

(56) References Cited

U.S. PATENT DOCUMENTS

| | | | | |
|---|---|---|---|---|
| 5,339,785 | A * | 8/1994 | Wilksch | 123/457 |
| 5,651,347 | A | 7/1997 | Oi et al. | |
| 7,546,832 | B2 * | 6/2009 | Okamoto et al. | 123/506 |
| 7,568,469 | B2 * | 8/2009 | Tokuo et al. | 123/497 |
| 7,574,995 | B2 * | 8/2009 | Graham | 123/506 |
| 7,591,239 | B2 * | 9/2009 | Okamoto | 123/179.17 |
| 7,735,472 | B2 * | 6/2010 | Okamoto et al. | 123/456 |
| 8,079,345 | B2 * | 12/2011 | Okamoto | 123/506 |
| 2003/0047818 | A1 * | 3/2003 | Nagata | 261/35 |
| 2008/0314364 | A1 * | 12/2008 | Okamoto | 123/458 |
| 2009/0068041 | A1 * | 3/2009 | Beardmore | 417/540 |
| 2009/0235900 | A1 * | 9/2009 | Okamoto et al. | 123/503 |
| 2010/0043754 | A1 | 2/2010 | Hirata | |
| 2010/0132670 | A1 * | 6/2010 | Okamoto | 123/458 |

FOREIGN PATENT DOCUMENTS

| | | | |
|---|---|---|---|
| DE | 199 13 477 | A1 | 10/2000 |
| DE | 10 2009 028 752 | A1 | 2/2010 |
| EP | 1 281 860 | A2 | 2/2003 |
| JP | 2010-25102 | A | 2/2010 |

OTHER PUBLICATIONS

European Search Report dated Nov. 9, 2011 (Seven (7) pages).

* cited by examiner

*Primary Examiner* — Stephen K Cronin
*Assistant Examiner* — Joseph Dallo
(74) *Attorney, Agent, or Firm* — Crowell & Moring LLP

(57) ABSTRACT

A high pressure fuel pump control system for an internal combustion engine includes a fuel injection valve provided in a fuel common rail and a high pressure fuel pump for feeding fuel by pressure to the fuel injection valve. The high pressure fuel pump includes a pressurized chamber, a plunger for pressurizing fuel in the pressurized chamber, a discharge valve provided in a discharge passage, an intake valve provided in an intake passage, and an actuator for operating the intake valve. The control system includes a means for calculating a drive signal for the actuator to make a discharge amount or pressure of the high pressure fuel pump variable. The means reduces pressure in the common rail by opening the discharge valve to return the fuel in the fuel common rail to the pressurized chamber when a requirement for reducing the pressure in the fuel common rail is made.

6 Claims, 20 Drawing Sheets

HIGH PRESSURE FUEL PUMP CONTROL SYSTEM FOR INTERNAL COMBUSTION ENGINE

BACKGROUND OF THE INVENTION

1. Field of the Invention

The present invention relates to a system of an internal combustion engine mounted on an automobile or the like, and particularly relates to a high pressure fuel supply system including a high pressure fuel pump.

2. Description of the Prior Art

In an in-cylinder injection engine which has been developed in recent years, fuel injection by a fuel injection valve is carried out directly into a combustion chamber of a cylinder, and combustion of fuel is promoted by reducing a particle size of the fuel injected from the fuel injection valve, so that reduction of emission gas substances, enhancement of engine output power and the like are achieved.

Here, in order to reduce the particle size of the fuel injected from the fuel injection valve, a means for increasing pressure of the fuel is required. Until now, there have been proposed various arts relating to a high pressure fuel supply system which is constituted by a fuel injection valve, a pressure accumulation container (hereinafter, called a common rail) for accumulating fuel to be injected from the fuel injection valve under pressure, a high pressure fuel pump for supplying the fuel to the common rail, and the like. Fuel efficiency and emission gas can be more improved when the fuel pressure in the common rail is changed in accordance with the operating state of the internal combustion engine. In this case, if target fuel pressure and actual fuel pressure of the fuel pressure deviate from each other, the fuel efficiency and the emission gas are likely to be worsened conversely.

In a conventional high pressure fuel supply system, the fuel pressure in the common rail is controlled by regulating the balance of the high pressure pump which supplies fuel to the common rail and the fuel injection valve which injects the fuel contained in the common rail (see JP-A-2010-25102).

BRIEF SUMMARY OF THE INVENTION

In the case of the fuel pressure control depending on the balance of the high pressure fuel pump and the fuel injection valve, it may not be possible to quickly respond to a pressure reduction requirement. This is because the fuel injection amount from the fuel injection valve which plays the role of reducing the pressure in the common rail is determined on the basis of the required output power of the internal combustion engine and the like. That is, when the required output power of the internal combustion engine is small, the fuel injection amount becomes small, and therefore there is a limit of the pressure reduction by injection of the fuel injection valve. In particular, during fuel cut when the fuel injected by the fuel injection valve is stopped in a region where the engine output power is not required, the pressure in the common rail cannot be reduced as long as a pressure reducing mechanism, e.g., an electronic controlled relief valve or the like which returns the fuel within the common rail to the low pressure side is not prepared.

A high pressure fuel pump control system for an internal combustion engine according to the present invention positively uses a backflow region caused by delay of closing of a discharge valve of a high pressure fuel pump configured by a check valve (a region in which the fuel in the common rail flows backward through the discharge valve to return to the high pressure fuel pump side), so that the pressure in the common rail is reduced.

In other words, after the fuel in the pressurized chamber is pressurized by closing an intake valve at a desired timing during ascent of a plunger, and the fuel is discharged to the common rail by pushing and opening the discharge valve configured by the check valve, the plunger starts to descend during the closing delay period of the discharge valve, whereby the backflow region occurs. Then, the pressure in the common rail can be reduced by controlling the high pressure pump in the region where the backflow amount in the backflow region becomes larger than the discharge amount of the fuel pump.

According to the high pressure fuel pump control system for an internal combustion engine of the present invention, when a fuel pressure reduction requirement occurs, the fuel pressure can be reduced to a target fuel pressure by controlling the high pressure pump. In particular, since the fuel pressure can be reduced by controlling the high pressure fuel pump, the fuel pressure can be reduced even during the fuel cut.

Other objects, features and advantages of the invention will become apparent from the following description of the embodiments of the invention taken in conjunction with the accompanying drawings.

DETAILED DESCRIPTION OF THE INVENTION

Figure 1:
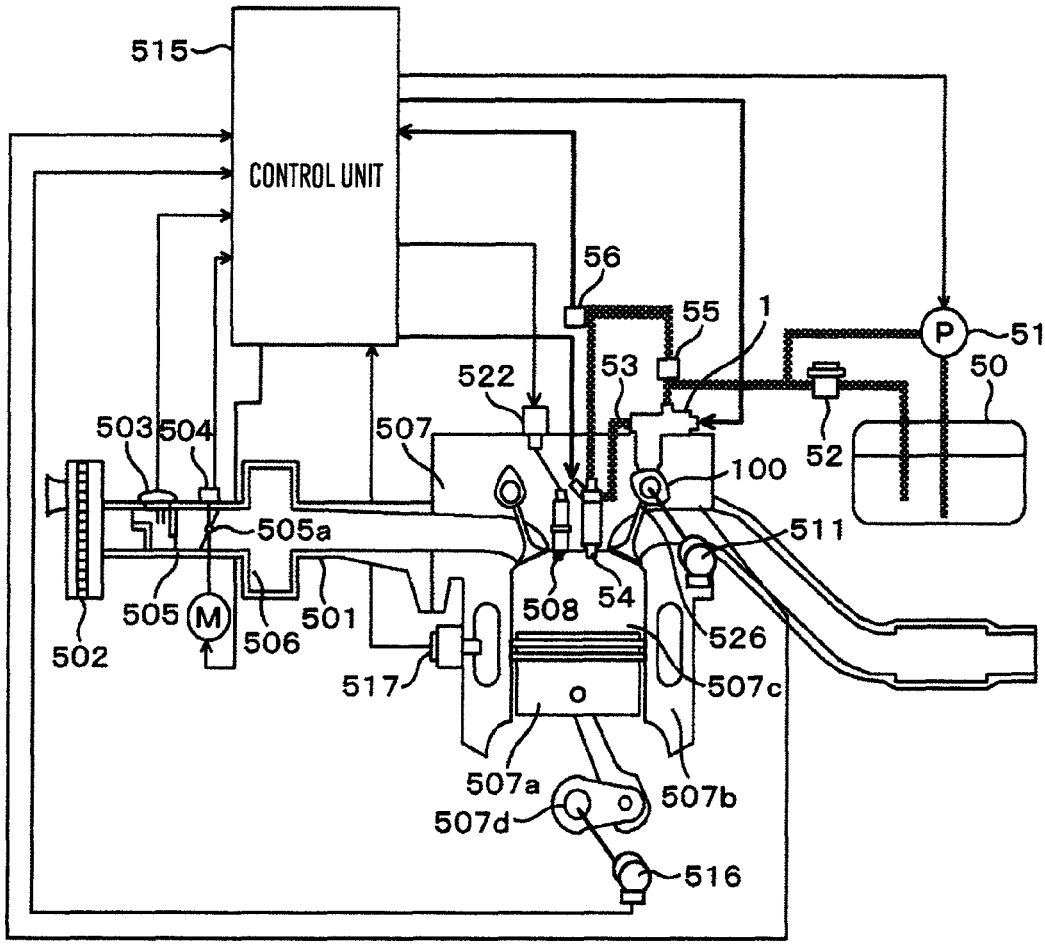
FIG. 1 is an entire configuration diagram of an engine including a high-pressure fuel pump control system for an internal combustion engine of an embodiment.

An embodiment according to the present invention is basically a high pressure fuel pump control system which takes fuel into a pressurized chamber by descent of a plunger, pressurizes the fuel in the pressurized chamber by closing an intake valve at a desired timing during ascent of the plunger, and discharges the fuel into a common rail from a discharge valve constituted of a check valve, wherein when a pressure reduction requirement occurs, pressure in the common rail is reduced by closing the intake valve at a timing when a backflow amount which flows back through the discharge valve from the common rail to return into the pressurized chamber becomes larger than a discharge amount discharged from the discharge valve.

Further, a valve opening phase of the discharge valve is calculated by using at least one of the pressure in the common rail, an engine speed, and a target pressure in the common rail. Since the fuel backflow region changes in accordance with the fuel pressure acting on the operation of the discharge valve, the engine speed and the like, precision of pressure reduction control can be enhanced by taking them into consideration.

Furthermore, the timing of closing the intake valve is retrieved by starting from a timing at which the high pressure fuel pump is in a non-discharging state so that the timing becomes a timing at which the backflow amount which flows back through the discharge valve from the common rail to return into the pressurized chamber becomes larger than the discharge amount discharged from the discharge valve. Since the timing when the backflow amount flowing back through the discharge valve from the common rail to return into the pressurized chamber becomes larger than the discharge amount discharged from the discharge valve is influenced by variations of objects, the pressure difference between the pressurized chamber and the inside of the common rail, the operating state of the internal combustion engine and the like, robustness of pressure reduction control can be enhanced by performing control by starting from the non-discharging region so that the intake valve can be closed at the timing where pressure reduction control can be performed so as to repeat spark-advance or spark-delay, once, twice or more.

Further, the pressure reduction requirement is made based on at least one of the pressure in the common rail and the target pressure. This is because the pressure reduction requirement is made by the requirement from the outside when the actual fuel pressure in the common rail is desired to be reduced, when the target fuel pressure is reduced, when the actual fuel pressure is lower than the target fuel pressure, and the like.

Furthermore, by using at least one of the pressure in the common rail and the target pressure, a state is switched to any one of a state in which the fuel in the common rail is returned to a pump pressurized chamber, a high pressure fuel pump non-discharging state, and a high pressure fuel pump discharging state. During the fuel cut, the pressure reduction effect in the common rail by the fuel injection valve cannot be expected. However, according to this configuration, control can be performed so that the actual fuel pressure becomes a desired target fuel pressure at the time of returning from the fuel cut by switching pressure reduction control using the backflow region of the high pressure fuel pump, pressurizing control by fuel discharge, and non-discharging control of performing control in a non-discharging region. The pressurizing control can be performed by closing the intake valve of the high pressure fuel pump in the present embodiment at a desired timing (except for the vicinity of the upper dead point) during ascent of the plunger. Further, non-discharging control can be performed by always keeping the intake valve open during ascent of the plunger, for example.

Furthermore, the target fuel pressure and the actual fuel pressure in the common rail at the time of returning from the fuel cut can be matched with each other or brought close to each other by reducing the pressure in the common rail by closing the intake valve at a timing when a backflow amount which flows back through the discharge valve from the common rail to return into the pressurized chamber becomes larger than a discharge amount which is discharged from the discharge valve, so that the pressure in the common rail becomes a target fuel pressure after returning from the fuel cut, and therefore, reduction in stability of combustion or worsening of the emission gas after returning from the fuel cut can be suppressed.

Hereinafter, one embodiment of a high pressure fuel supply control system in an internal combustion engine of the present invention will be described in more detail based with reference to the drawings. FIG. 1 shows an entire configuration of a control system of an in-cylinder injection engine 507 of the present embodiment. The in-cylinder injection engine 507 is constituted of four cylinders, and air which is to be introduced into each of cylinders 507*b* is taken in from an inlet port portion of an air cleaner 502, passes through an air flow meter (air flow sensor) 503, and enters a collector 506 through a throttle body 505 which houses an electronically controlled throttle valve 505*a* which controls an intake air flow rate. The air taken into the aforesaid collector 506 is distributed to each of intake pipes 501 connected to each of the cylinders 507*b* of the engine 507, and thereafter, is guided into a combustion chamber 507*c* which is formed by a piston 507*a*, the aforesaid cylinder 507*b* and the like. Further, from the aforesaid air flow sensor 503, a signal expressing the aforesaid intake air flow rate is outputted to an engine control device (control unit) 515 having the high pressure fuel pump control system of the present embodiment. Further, a throttle sensor 504 which detects an opening degree of the electronically controlled throttle valve 505*a* is mounted to the aforesaid throttle body 505, and the signal thereof is also outputted to the control unit 515.

Meanwhile, a fuel such as gasoline is subjected to primary pressurization by a low-pressure fuel pump 51 from a fuel tank 50 so as to be regulated to a fixed pressure (for example, 3 kg/cm$^2$) by a fuel pressure regulator 52, is subjected to secondary pressurization to a higher pressure (for example, 50 kg/cm$^2$) with a high-pressure fuel pump 1 which will be described later, and is injected to the combustion chamber 507*c* from a fuel injection valve (hereinafter, called an injector) 54 provided in each of the cylinders 507*b* through a common rail 53. The fuel which is injected to the aforesaid combustion chamber 507*c* is ignited with an ignition plug 508 by a high-voltage ignition signal with an ignition coil 522.

A crank angle sensor (hereinafter, called a position sensor) 516 which is mounted to a crankshaft 507*d* of the engine 507 outputs a signal expressing a rotation position of the crankshaft 507*d* to the control unit 515, and a crank angle sensor (hereinafter, called a phase sensor) 511 which is mounted to a camshaft (not illustrated) having a mechanism which makes an opening and closing timing of an exhaust valve 526 variable outputs an angle signal expressing a rotation position of the aforesaid camshaft to the control unit 515, and also outputs an angle signal expressing a rotation position of a pump drive cam 100 of the high pressure fuel pump 1 which rotates with the rotation of the camshaft of the exhaust valve 526 to the control unit 515.

Figure 2:
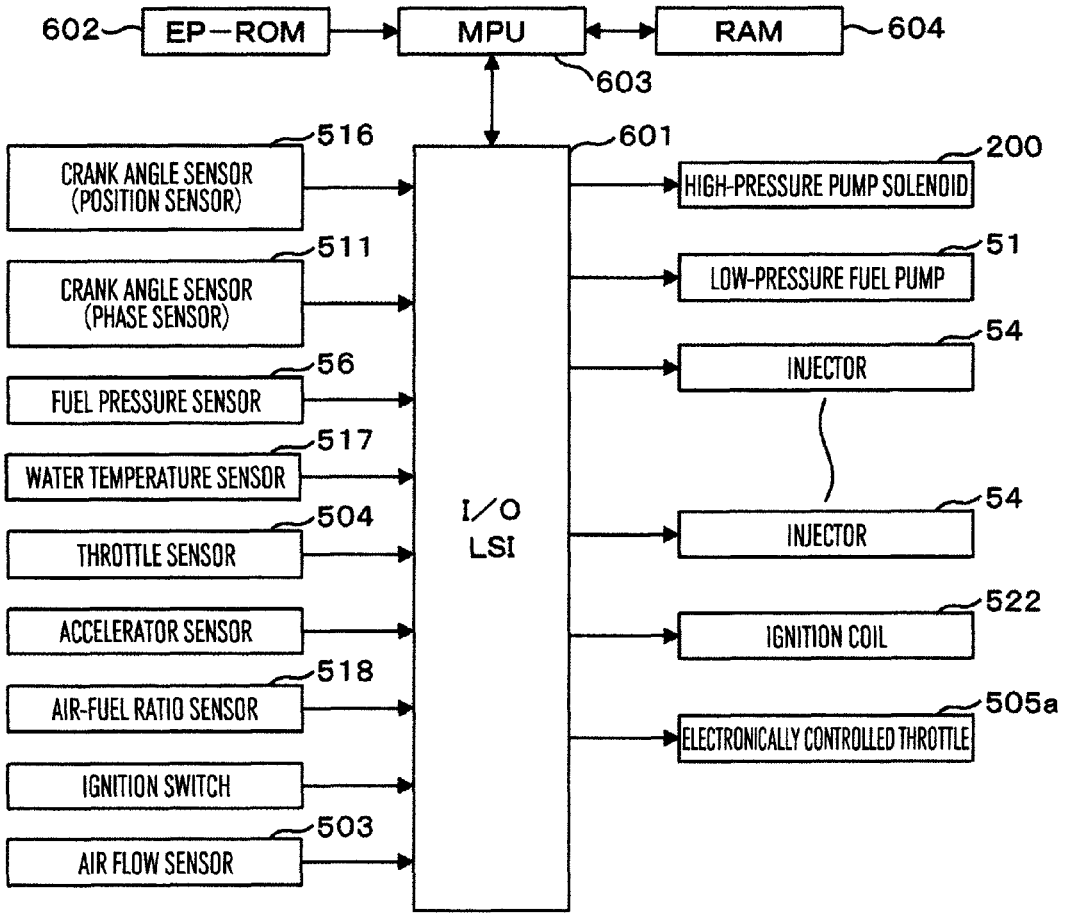
FIG. 2 is an internal configuration diagram of the engine control system of FIG. 1.

As shown in FIG. 2, a main part of the aforesaid control unit 515 is configured by an MPU 603, an EP-ROM 602, a RAM 604, an I/O LSI 601 including an A/D converter and the like, takes in signals from various sensors and the like including the position sensor 516, the phase sensor 511, a water temperature sensor 517 and a fuel pressure sensor 56, executes predetermined calculation processing, outputs various control signals calculated as a calculation result, and supplies predetermined control signals to a high pressure pump solenoid 200 which is an actuator, the aforesaid respective injectors 54, the ignition coil 522 and the like to execute fuel discharge amount control, fuel injection amount control, ignition timing control and the like.

Figure 3:
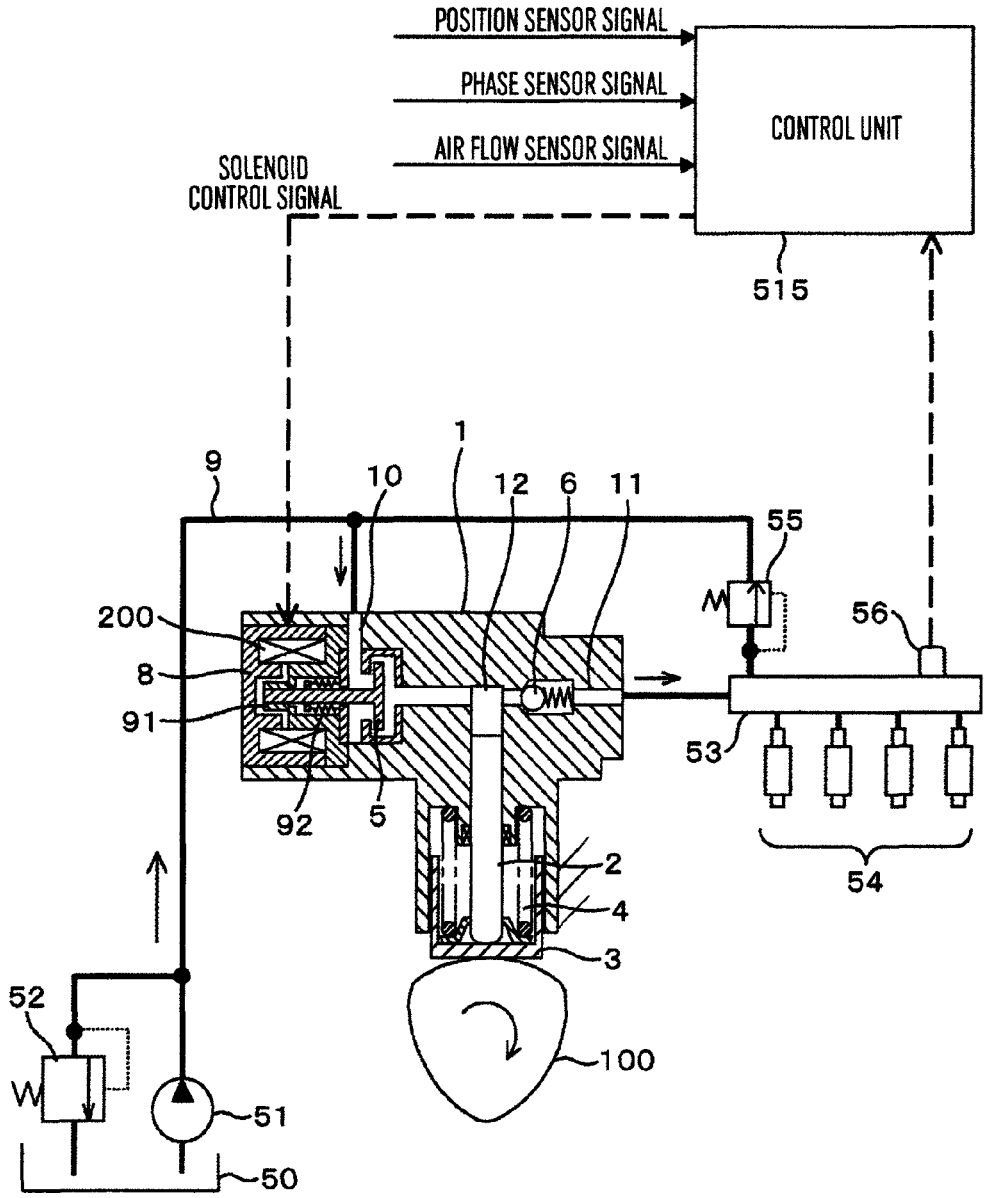
FIG. 3 is an entire configuration diagram of a fuel system including the high pressure fuel pump of FIG. 1.
Figure 4:
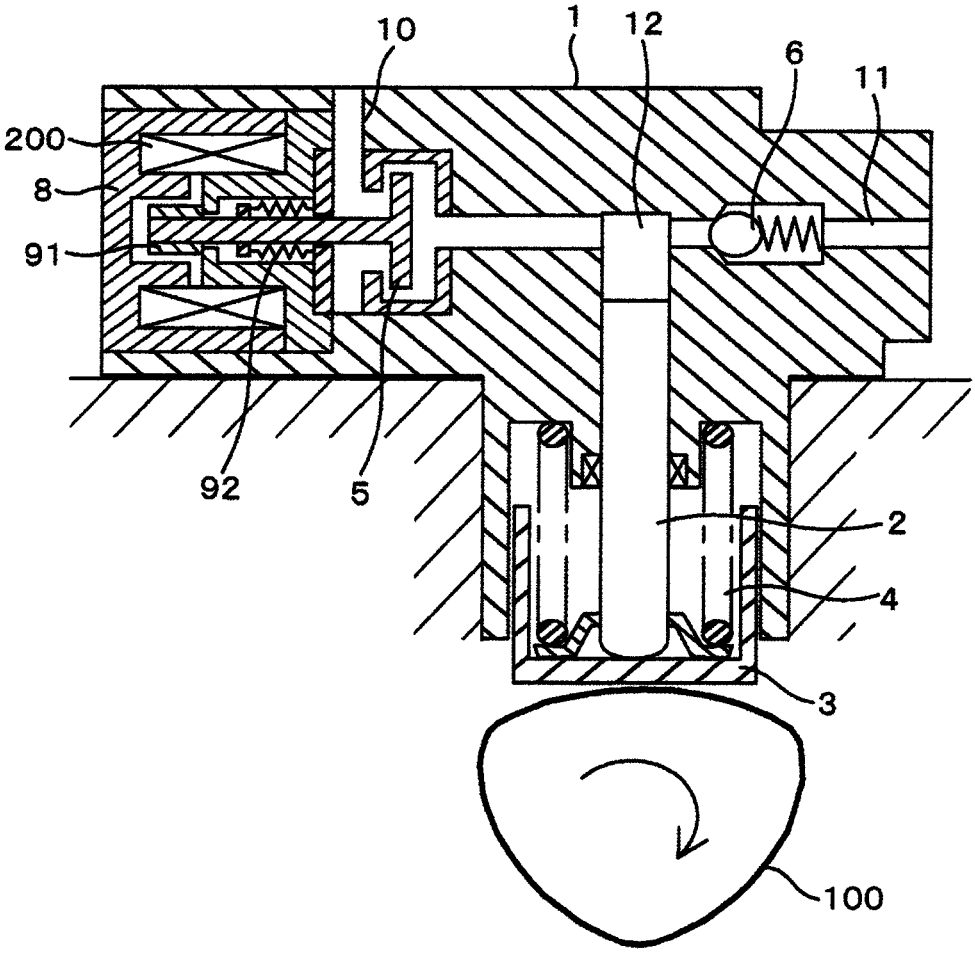
FIG. 4 is a vertical sectional view of the high pressure fuel pump of FIG. 3.

FIG. 3 shows an entire configuration diagram of the fuel system including the aforesaid high-pressure fuel pump 1, and FIG. 4 shows a vertical sectional view of the aforesaid high pressure fuel pump 1.

The aforesaid high pressure fuel pump 1 pressurizes the fuel from the fuel tank 50 and feeds the high pressure fuel by pressure to the common rail 53, and a fuel intake passage 10, a discharge passage 11 and a pressurized chamber 12 are formed therein. In the pressurized chamber 12, a plunger 2 which is a pressurizing member is slidably held. The discharge passage 11 is provided with a discharge valve 6. Further, the intake passage 10 is provided with an electromagnetic valve 8 which controls intake of the fuel. The electromagnetic valve 8 is a normal closed type electromagnetic valve, in which a force acts in a valve closing direction at a non-energized time and a force acts in a valve opening direction at an energized time.

The fuel has a pressure regulated to a fixed pressure by the pressure regulator 52, and is guided to a fuel introduction port of the pump main body 1 from the tank 50 by the low-pressure fuel pump 51. Thereafter, the fuel is pressurized in the pump main body 1, and is fed by pressure to the common rail 53 from a fuel discharge port. The injector 54, the pressure sensor 56 and a pressure regulation valve (hereinafter, called a relief valve) 55 are attached to the common rail 53. The relief valve 55 opens when the fuel pressure in the common rail 53 exceeds a predetermined value to prevent breakage of a high-pressure piping system. The injectors 54 the number of which is the same as the number of cylinders of the engine are attached, and inject the fuel in accordance with a drive current which is given by the control unit 515. The pressure sensor 56 outputs acquired pressure data to the control unit 515. The control unit 515 calculates a suitable injection fuel amount, fuel pressure and the like based on the engine state amounts (for example, a crank rotation angle, a throttle opening degree, an engine speed, a fuel pressure and the like) which are obtained from the various sensors, and controls the pump 1 and the injector 54.

The plunger 2 reciprocates via a lifter 3 which is in pressure contact with a pump drive cam 100 which rotates in accordance with rotation of the camshaft of the exhaust valve 526 in the engine 507, and changes the volume of the pressurized chamber 12. When the plunger 2 descends and the volume of the pressurized chamber 12 increases, the electromagnetic valve 8 is opened, and the fuel flows into the pressurized chamber 12 from the fuel intake passage 10. The stroke in which the plunger 2 descends will be described as an intake stroke hereinafter. When the plunger 2 ascends, and the electromagnetic valve 8 is closed, the fuel in the pressurized chamber 12 is increased in pressure, and passes through the discharge valve 6 to be fed by pressure to the common rail 53. The stroke in which the plunger 2 ascends will be described as a compression stroke hereinafter.

Figure 5:
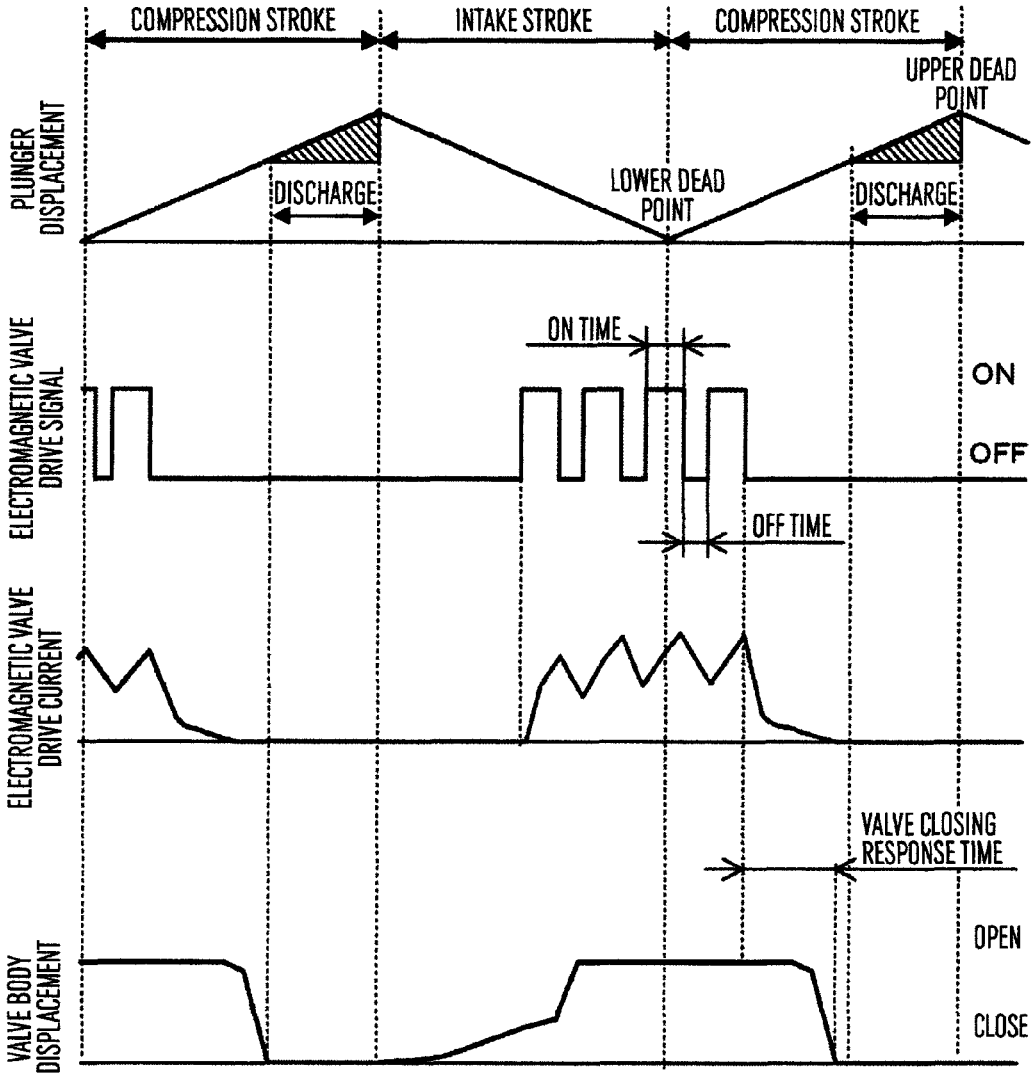
FIG. 5 is an operation timing chart of the high pressure fuel pump of FIG. 3.
Figure 6:
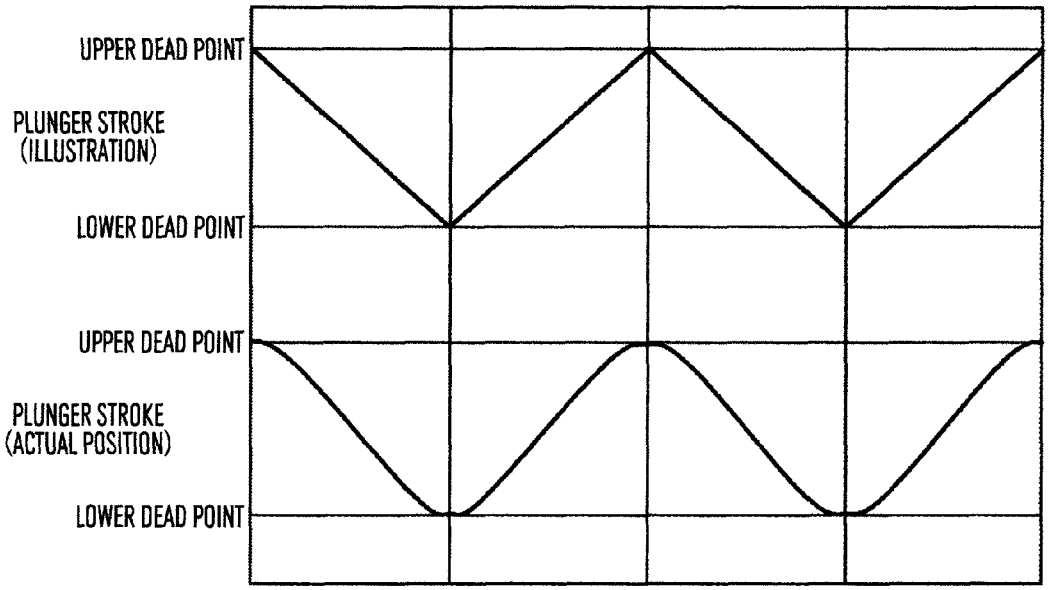
FIG. 6 is a supplemental explanatory diagram of the operation timing chart of FIG. 5.

FIG. 5 shows an operation timing chart of the aforesaid high pressure fuel pump 1. The actual stroke (actual position) of the plunger 2 which is driven by the pump drive cam 100 becomes a curve as shown in FIG. 6, but in order to make the positions of the upper dead point and the lower dead point easier to understand, the stroke of the plunger 2 will be expressed to be linear hereinafter.

When the electromagnetic valve 8 is closed during the compression stroke, the fuel taken into the pressurized chamber 12 during the intake stroke is pressurized and is discharged to the side of the common rail 53. If the electromagnetic valve 8 is opened during the compression stroke, the fuel is pushed back to the side of the intake passage 10 during this while, and the fuel in the pressurized chamber 12 is not discharged to the side of the common rail 53. In this manner, the fuel discharge of the pump 1 is operated by opening and closing of the electromagnetic valve 8. Opening and closing of the electromagnetic valve 8 is operated by the control unit 515.

The electromagnetic valve 8 has a valve body 5, a spring 92 which urges the valve body 5 in the valve closing direction, a solenoid 200 and an anchor 91, as components. When current flows into the solenoid 200, an electromagnetic force occurs in the anchor 91, the valve is drawn to the right side in the drawing, and the valve body 5 which is formed integrally with the anchor 91 is opened. If the current does not flow into the solenoid 200, the valve body 5 is closed by the spring 92 which urges the valve body 5 in the valve closing direction. The electromagnetic valve 8 has the structure which is closed in a state where drive current is not passed, and therefore, is called a normal closed type electromagnetic valve.

During the intake stroke, the pressure of the pressurized chamber 12 becomes lower than the pressure of the intake passage 10, the valve body 5 is opened by the pressure difference, and the fuel is taken into the pressurized chamber 12. At this time, the spring 92 urges the valve body 5 in the valve closing direction, but the valve opening force by the pressure difference is set to be larger, and therefore, the valve body 5 is opened. If the drive current flows into the solenoid 200 here, a magnetic attraction force acts in the valve opening direction, and the valve body 5 is opened more easily.

Meanwhile, during the compression stroke, the pressure of the pressurized chamber 12 becomes higher than that of the intake passage 10, and therefore, the pressure difference which opens the valve body 5 does not occur. If the drive current does not flow into the solenoid 200 here, the valve body 5 is closed by the spring force or the like which urges the valve body 5 in the valve closing direction. Meanwhile, if the drive current flows into the solenoid 200 and a sufficient magnetic attraction force occurs, the valve body 5 is urged in the valve opening direction by the magnetic attraction force.

Consequently, if the drive current starts to be supplied to the solenoid 200 of the electromagnetic valve 8 during the intake stroke, and continues to be supplied to it during the compression stroke, the valve body 5 is kept open. During this while, the fuel in the pressurized chamber 12 flows back to the low-pressure passage 10, and therefore, the fuel is not fed by pressure into the common rail. Meanwhile, if supply of the drive current is stopped at a certain timing during the compression stroke, the valve body 5 is closed, and the fuel in the pressurized chamber 12 is pressurized, and is discharged to the side of the discharge passage 11. If the timing of stopping the supply of the drive current is early, the volume of the fuel which is pressurized becomes large, and if the timing is late, the volume of the fuel which is pressurized becomes small. Therefore, the control unit 515 can control the discharge flow rate of the pump 1 by controlling the timing of closing the valve body 5.

Furthermore, in the control unit 515, a suitable timing of turning OFF energization is calculated based on the signal of the pressure sensor 56, and the solenoid 200 is controlled, whereby the pressure of the common rail 53 can be subjected to feedback controlled to a target value.

Figure 7:
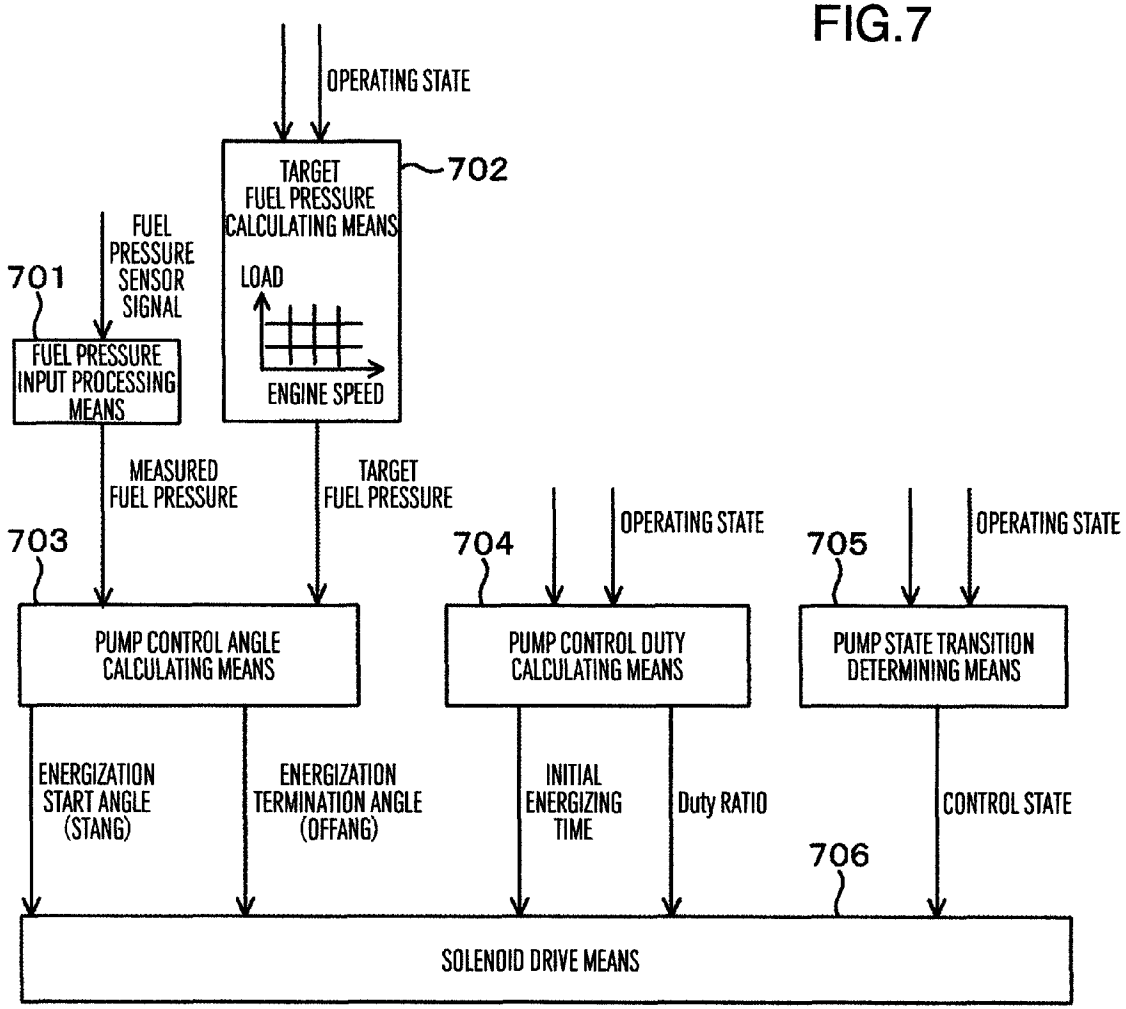
FIG. 7 is a control block diagram of the present invention according to the internal combustion engine control system of FIG. 1.

FIG. 7 is one mode of a block diagram of control of the high pressure fuel pump 1 that is carried out by the MPU 603 of the control unit 515 having the aforesaid high pressure fuel pump control system. The aforesaid high pressure fuel pump control system is configured by a fuel pressure input processing means 701 which performs filter processing of a signal from the fuel pressure sensor 56 and outputs an actual fuel pressure, a target fuel pressure calculating means 702 which calculates a target fuel pressure optimal for an operation point based on an engine speed and a load, a pump control angle calculating means 703 which calculates a phase parameter for controlling a discharge flow rate of the pump, a pump control DUTY calculating means 704 which calculates a parameter of a duty signal which is a pump drive signal, a pump state transition determining means 705 which determines a state of the in-cylinder injection engine 507 and transitions a pump control mode, and a solenoid drive means 706 which supplies current, which is generated from the aforesaid duty signal, to the solenoid 200.

Figure 8:
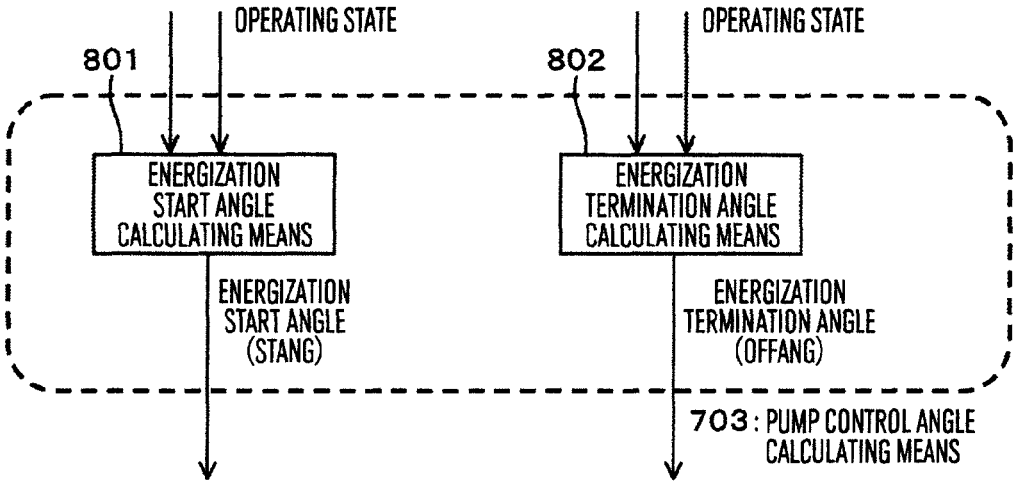
FIG. 8 is a control block diagram of the present invention according to the internal combustion engine control system of FIG. 1.

FIG. 8 shows one mode of the pump control angle calculating means 703. The pump control angle calculating means 703 is configured by an energization start angle calculating means 801 and an energization termination angle calculating means 802.

Figure 9:
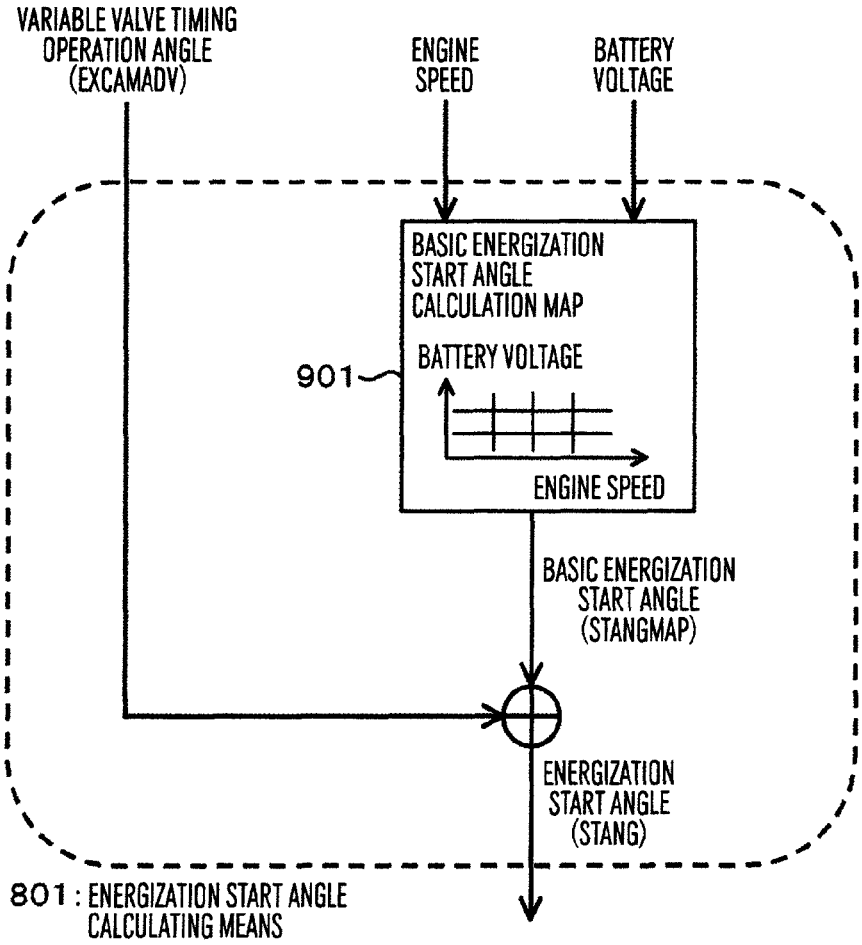
FIG. 9 is a control block diagram of the present invention according to the internal combustion engine control system of FIG. 1.

FIG. 9 shows one mode of the energization start angle calculating means 801. A basic energization start angle STANGMAP is calculated based on a basic energization start angle calculation map 901 in which the engine speed and battery voltage are inputted, and then an energization start angle STANG is calculated by correcting an amount of a phase difference EXCAMADV due to the variable valve timing mechanism of the aforesaid pump drive camshaft. In connection with the correction of the phase difference due to the variable valve timing mechanism, subtraction is performed in the case that the variable valve timing mechanism operates to the advance side with respect to the position of the operation angle of zero, whereas addition is performed in the case that the variable valve timing mechanism operates to the delay side. The present embodiment is on the precondition of the variable valve timing mechanism which operates to the delay side. Hereinafter, in connection with the pump control phase parameters, the ones which require the phase difference correction due to the variable valve timing mechanism will be based on the same concept.

Figure 10:
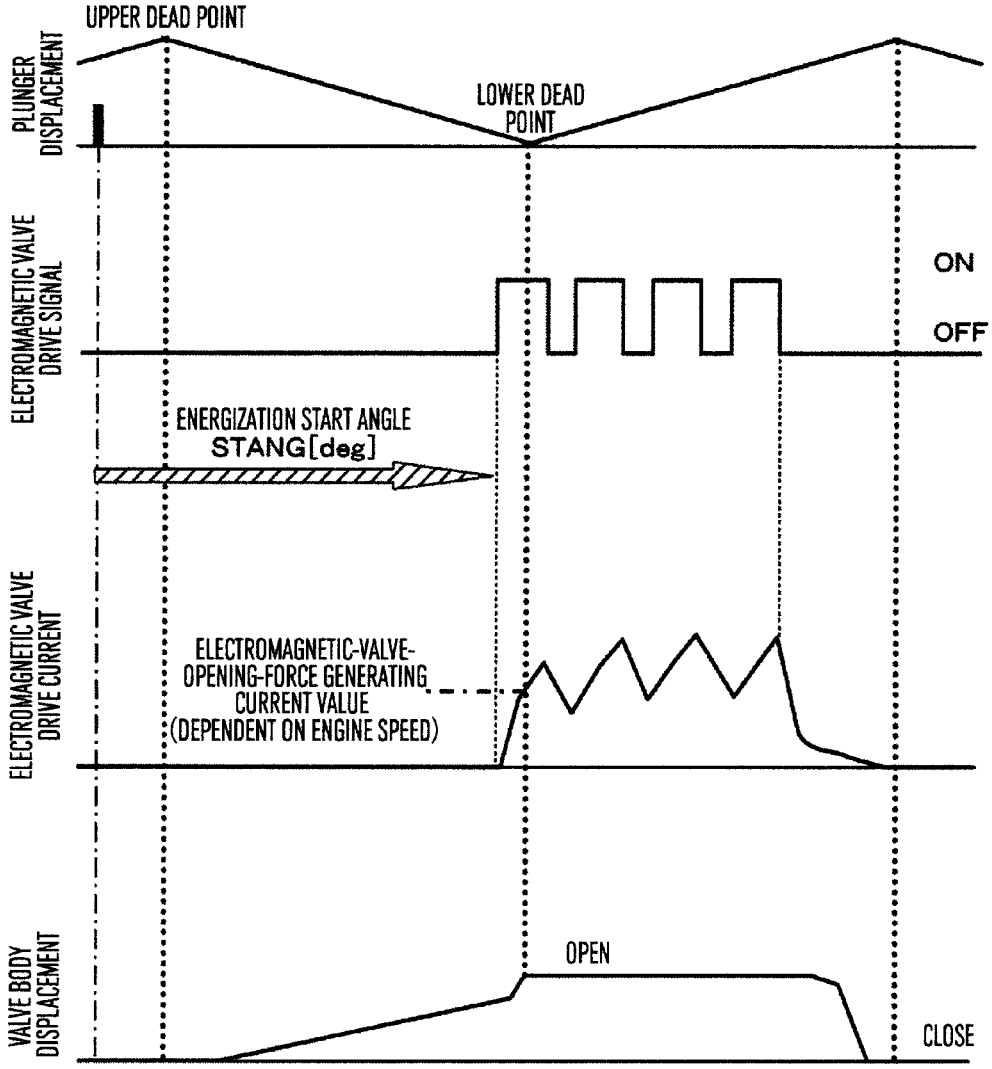
FIG. 10 is a pump control time chart according to the internal combustion engine control system of FIG. 1.

FIG. 10 shows a method for setting the basic energization start angle STANGMAP. The basic energization start angle STANGMAP is equal to the energization start angle STANG when the phase difference due to the variable valve timing mechanism is zero. The present pump is of a normal closed type, and therefore, the basic energization start angle STANGMAP is set so that the force which enables the electromagnetic valve 8 to open acts before the pump plunger reaches the lower dead point.

The force which enables the valve to open is the force which becomes large proportionally to the engine speed to surmount the fluid force in the pump which acts in the valve closing direction. Consequently, since the force which occurs in the solenoid is proportional to the current, it is necessary that a current of a fixed value or more flows into the solenoid 200 by the time of the pump lower dead point. The time in which the current reaches the aforesaid fixed value depends on the voltage of the battery which is the power supply to the solenoid 200, the aforesaid fixed value depends on the engine speed, and therefore, the aforesaid basic energization start angle calculation map 901 treats the engine speed and the battery voltage as input.

Figure 11:
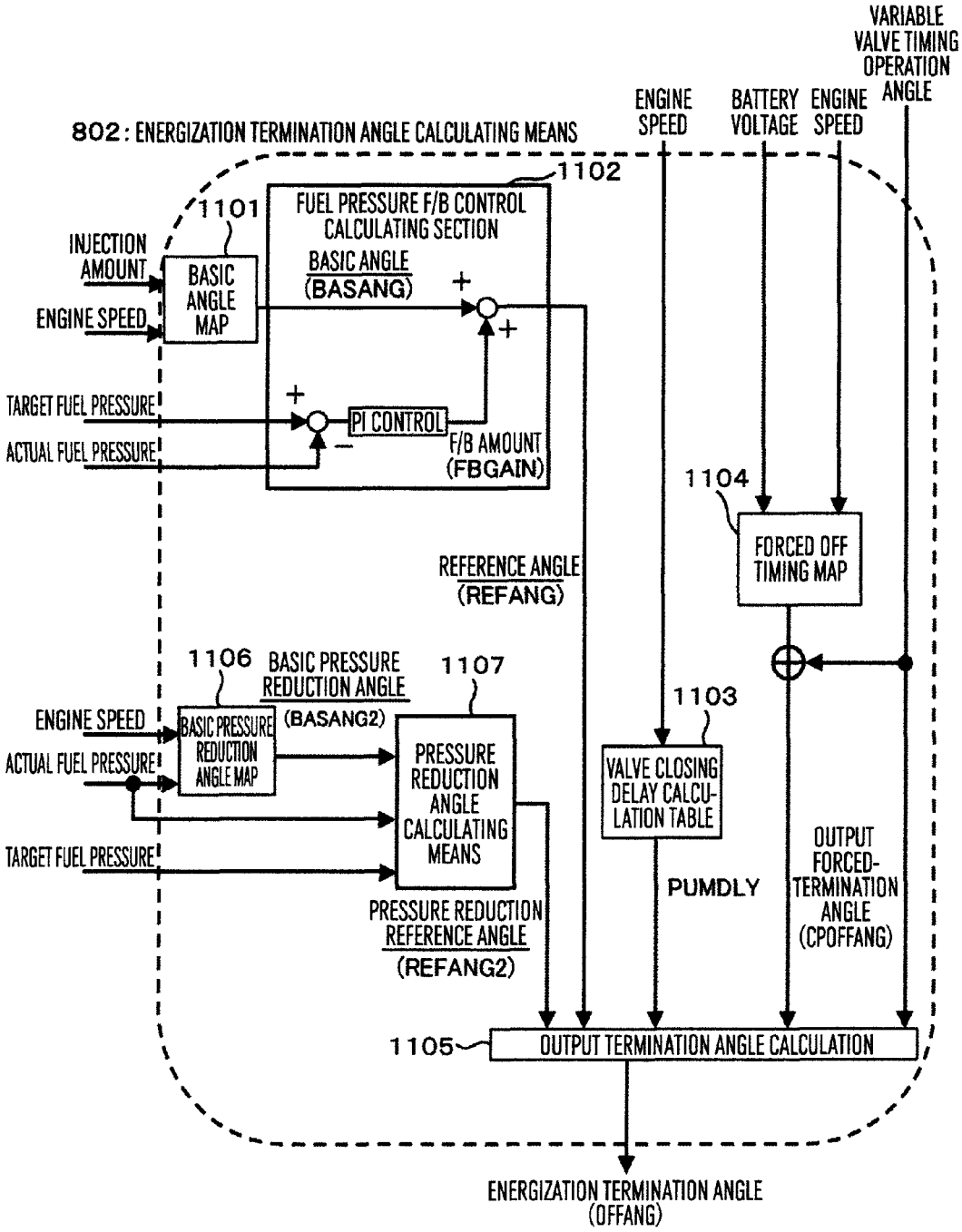
FIG. 11 is a control block diagram of the present invention according to the internal combustion engine control system of FIG. 1.

FIG. 11 shows one mode of the energization termination angle calculating means 802. In this pump, the discharge amount is controlled by changing the energization termination angle.

During fuel pressure FB control, a basic angle BASANG is calculated according to a basic angle map 1101 to which an injection amount by the injector and the engine speed are inputted. The BASANG sets a valve closing angle corresponding to a required discharge amount in a steady operation state.

In a fuel pressure FB control calculating section (1102), a reference angle REFANG is calculated by adding a FB amount, which is calculated based on the target fuel pressure and the actual fuel pressure, to the basic angle BASANG. The reference angle REFANG shows an angle at which the electromagnetic valve 8 is desired to be closed with respect to the reference REF in the case that the variable valve timing operation is assumed to be absent. Here, the reference REF is a position as a reference point of phase control. In the control unit 515, it is necessary to set the reference point in order to carry out output in the required phase.

During pressure reduction control, a basic pressure reduction angle BASANG2 is calculated according to a basic pressure reduction angle map 1106 to which the actual fuel pressure and the engine speed are inputted. The BASANG2 sets a valve closing angle in which cam variation and the like are taken into consideration on the basis of a fuel backflow region angle due to closing delay of the discharge valve of the high pressure fuel pump. The fuel backflow region changes in accordance with the fuel pressure acting on the operation of the discharge valve and the engine speed, and therefore, the aforesaid two parameters are inputted to the map 1106. In order to enhance precision more, viscosity of the fuel or the like may be taken into consideration.

In a pressure reduction angle calculating means 1107, a pressure reduction reference angle REFANG2 is calculated. The pressure reduction reference angle REFANG2 represents an angle at which the electromagnetic valve 8 is desired to be closed from the reference REF in the case that the variable valve timing operation is assumed to be absent.

An energization termination angle OFFANG is calculated by adding or subtracting a valve closing delay PUMDLY calculated from the table to which the engine speed is inputted and the variable valve timing operation angle to or from the reference angle REFANG or the pressure reduction reference angle REFANG2.

Further, the OFFANG has an upper limit value which is an output forced termination angle CPOFFANG. The CPOFFANG is the value which is obtained by adding the variable valve timing operation angle from the value of the map to which the engine speed and the battery voltage are inputted.

Figure 19:
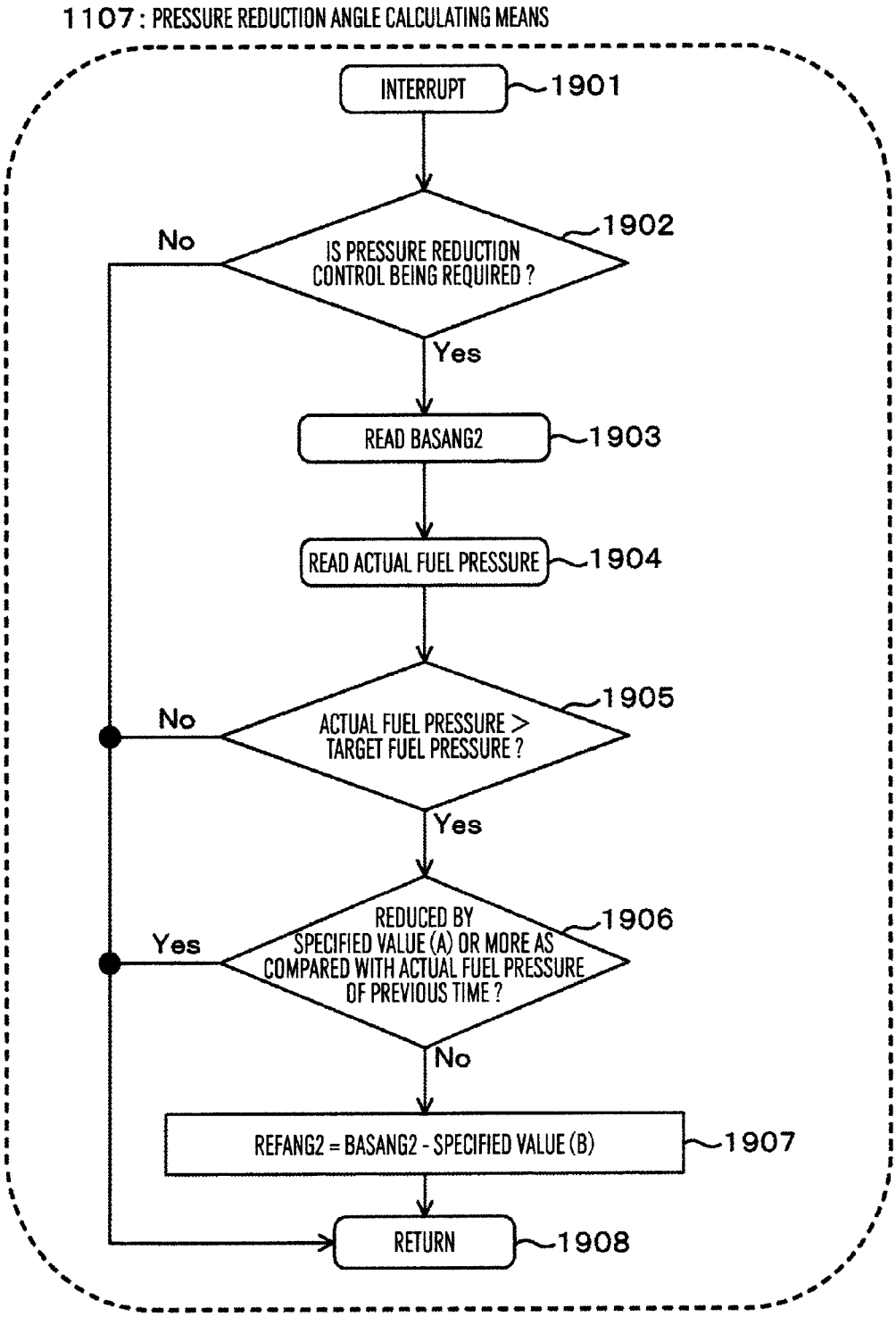
FIG. 19 is a control flowchart of the present invention according to the internal combustion engine control system of FIG. 1.

FIG. 19 shows a control flowchart of the pressure reduction angle calculating means 1107 showing one embodiment of the present invention. Step 1901 is interrupt processing and performs calculation at intervals of 10 ms or intervals of the reference REF, for example. In step 1902, it is determined whether pressure reduction control is being required. If it is being required, the flow proceeds to step 1903. In steps 1903 and 1904, the BASANG2 and the actual fuel pressure are read. In step S1905, it is determined whether the actual fuel pressure in the common rail is higher than the target fuel pressure. If it is higher, the flow proceeds to step 1906. In step 1906, it is determined whether the fuel pressure of this time is reduced by a specified value or more as compared with the fuel pressure at the time of interrupt calculation of the previous time. An object of the present step is to determine presence or absence of arrival at the fuel backflow phase. If it is determined that the fuel pressure is not reduced in step 1906, the fuel reaches the backflow phase, and therefore, the REFANG2 is obtained by subtracting a specified value (B) from the BASANG. The specified value (B) is the value which increases every time the flow passes step 1907, and when the BASANG2 is changed, the specified value (B) is cleared. Further, although the subtraction is performed in the present embodiment, but addition may be performed depending on setting of the BASANG2.

Figure 20:
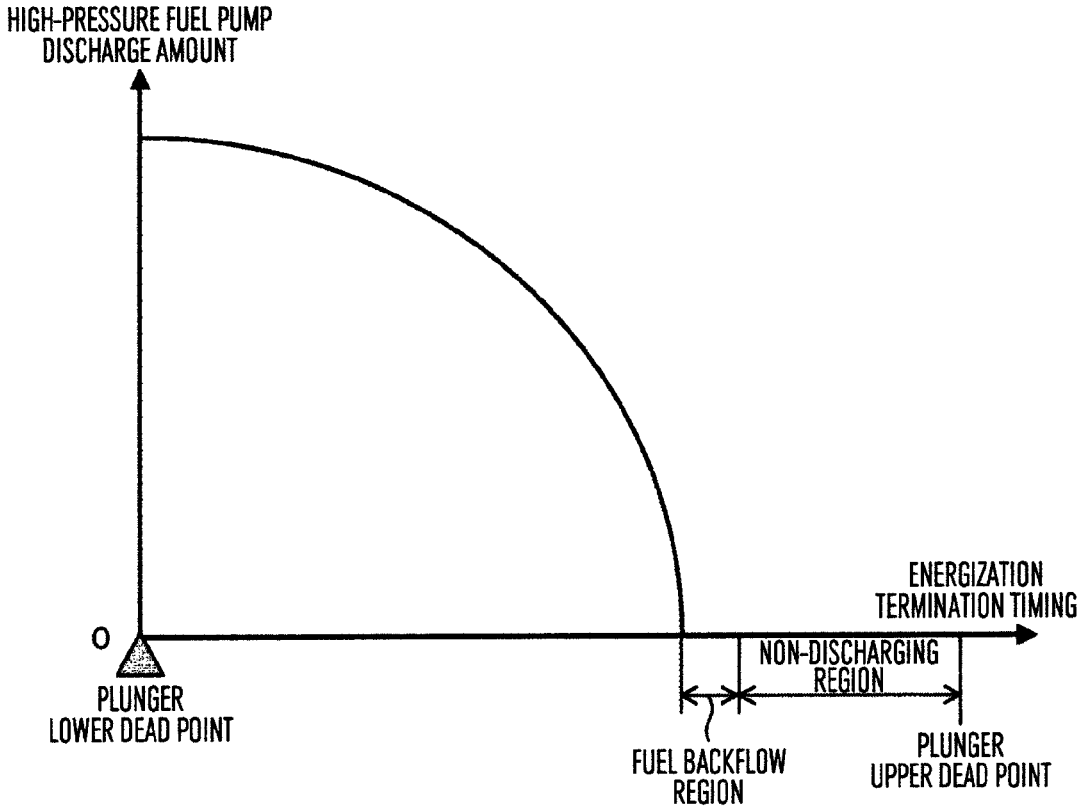
FIG. 20 shows an operation characteristic of the high pressure fuel pump of FIG. 3, and FIGS. 21A-B are diagrams for explaining one example of an effect of the present invention according to the internal combustion engine control system of FIG. 1.

FIG. 20 shows the relationship between the energization termination timing and the discharge amount in the pump normal closed type pump. The control flowchart shown in FIG. 19 has the mechanism which searches for the fuel back flow region.

Figure 12:
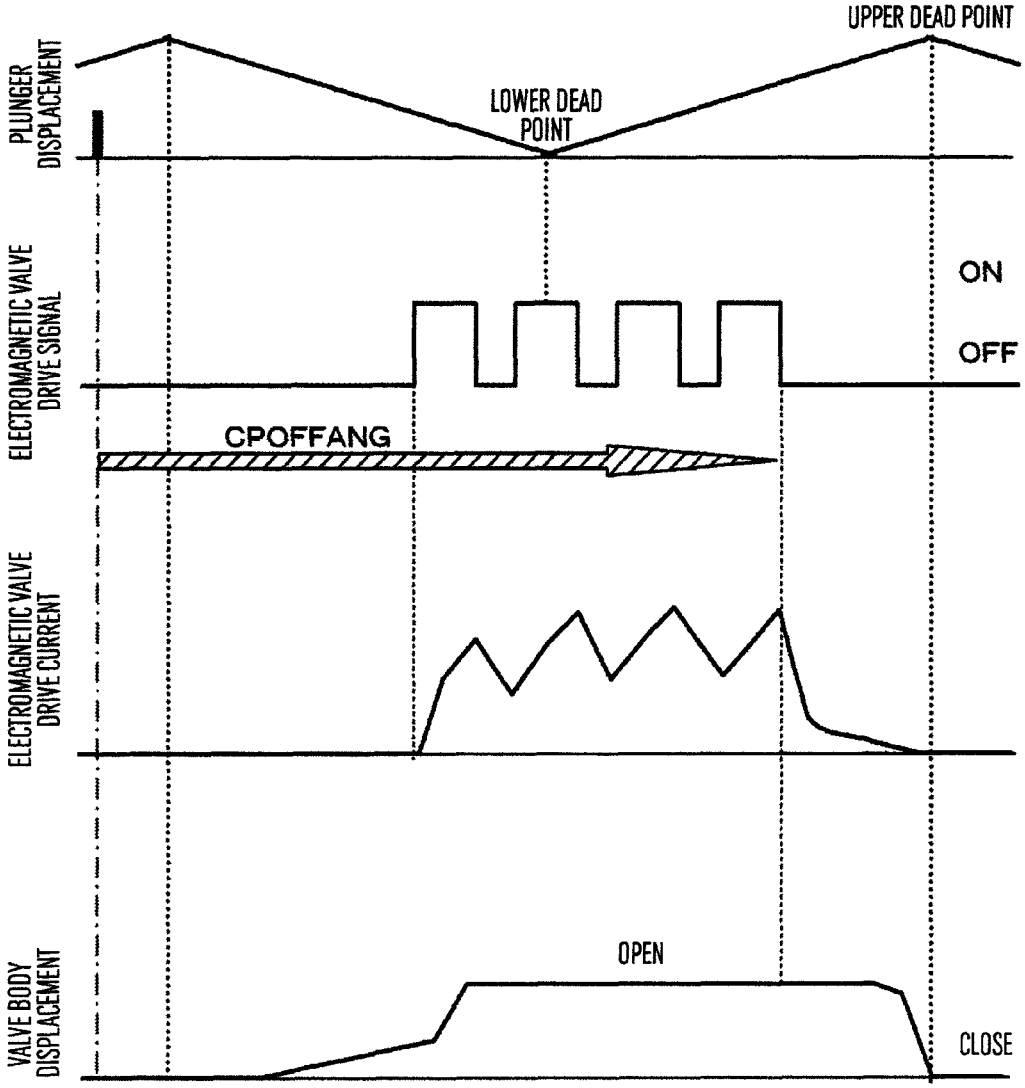
FIG. 12 is a pump control time chart according to the internal combustion engine control system of FIG. 1.

In FIG. 12, the concept of setting the output forced termination angle CPOFFANG is explained. An object of the CPOFFANG is to stop energization in the angle region which provides non-discharging even when energization is stopped, and to achieve reduction of power consumption and prevention of heat generation of the solenoid 200. As shown in FIG. 12, even if the drive signal is stopped before the upper dead point, valve closing delay occurs, and therefore, the valve is opened until the vicinity of the upper dead point, and the pump performs a non-discharging operation. Consequently, the output forced termination angle CPOFFANG can be set before the upper dead point (advance side).

The output forced termination angle CPOFFANG is also used when a pump non-discharging operation is required, and energization to the solenoid is terminated at this angle.

Figure 13:
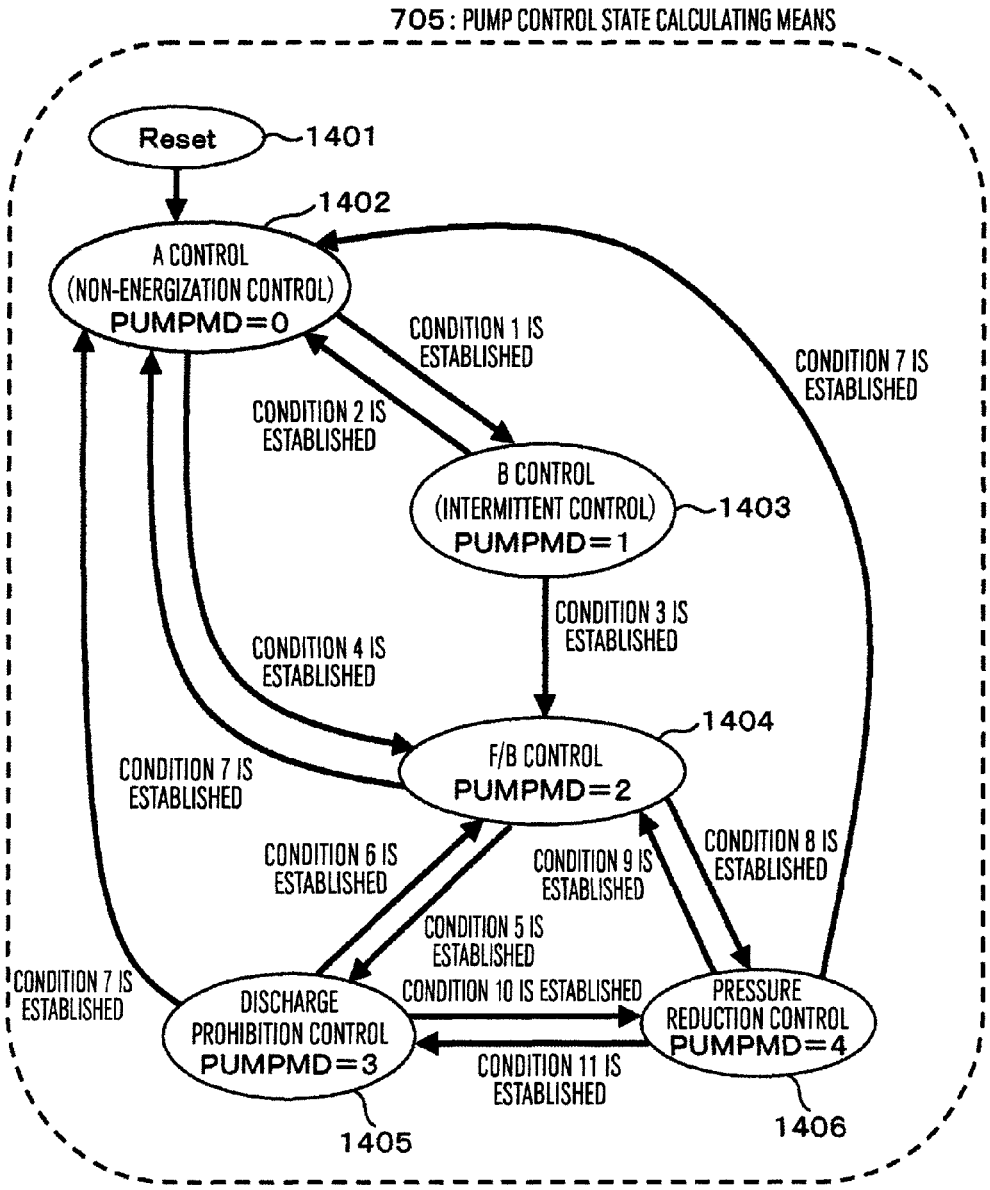
FIG. 13 is a control state transition diagram of the present invention according to the internal combustion engine control system of FIG. 1.

FIG. 13 shows a state transition diagram expressing one mode of the pump state transition determining means 705. The control block is configured by A control, B control, feedback control (hereinafter, described as F/B control), discharge prohibition control and pressure reduction control.

The A control is default control (non-energization control), and if the engine is rotating at the time of start, the pump carries out full discharge. The B control has an object to prevent pressure increase before recognition of the REF signal when the residual pressure in the common rail is high. In the F/B control, pressurized feeding is stopped for the purpose of performing control so that the inside of the common rail becomes the target fuel pressure, and in the discharge prohibition control, pressurized feeding is stopped for the purpose of prevention of pressure increase of the fuel pressure in the common rail during fuel cut (hereinafter, described as F/C). The pressure reduction control has an object to promote pressure reduction when a pressure reduction requirement of the fuel pressure occurs during F/C, or when pressure reduction responsiveness is desired to be enhanced during F/B control.

First, when the ignition switch is changed to ON from OFF, and the MPU 603 of the control unit 515 is brought into a reset state, the non-energization control state corresponding to the A control block 1402 is brought about, pump state variable: PUMPMD=0 is set, and energization to the solenoid 200 is not performed.

Next, when the starter switch is turned on, the engine 507 is brought into a cranking state, a crank angle signal CRANK is detected, and the fuel pressure in the common rail 53 is high, condition 1 is established, the control state transitions to a regular-interval energization control state corresponding to a B control block 1403, and the pump state variable: PUMPMD=1 is set. Here, the B control block 1403 is in the state where a pulse of the crank angle signal CRANK is detected, but recognition of the stroke of the plunger 2 which is the REF signal is not performed, and the plunger phases of the crank angle signal CRANK and a cam angle signal CAM are not settled, that is, in the state where the timing at which the plunger 2 of the high pressure fuel pump 1 comes to the lower dead point position cannot be recognized.

Figure 14:
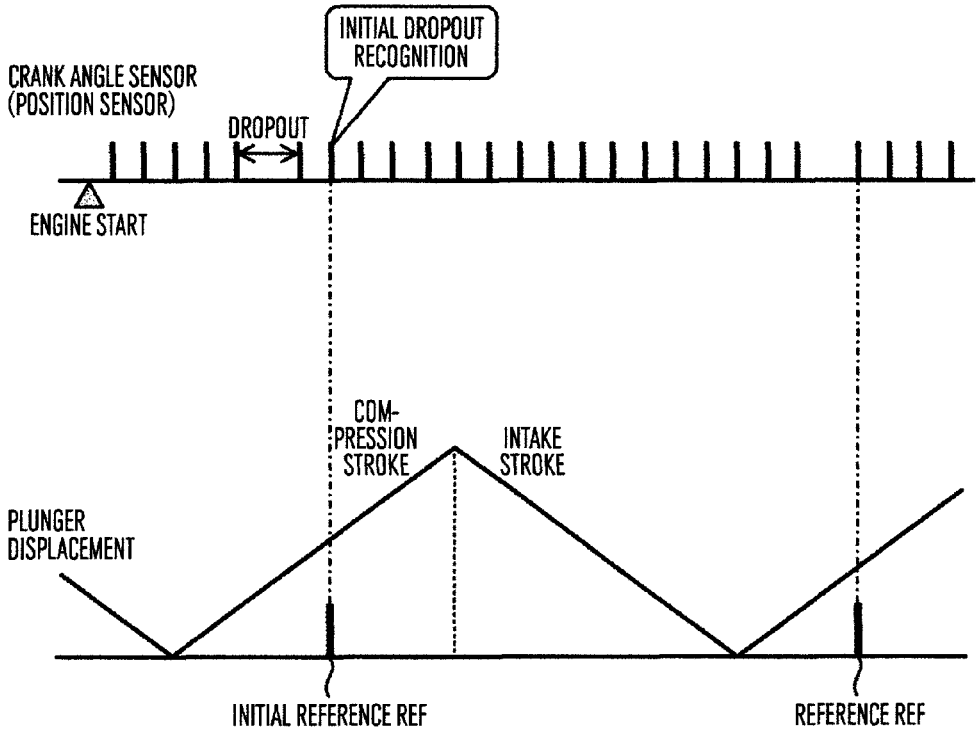
FIG. 14 is a pump control time chart according to the internal combustion engine control system of FIG. 1.

When the cranking state goes into the intermediate period from the initial period, the plunger phases of the crank angle signal CRANK and the cam angle signal CAM are settled, and the operation state is brought into the state capable of generating the reference REF, condition 3 is established, the control block transitions to an F/B control block 1404, the pump state variable: PUMPMD=2 is set, and a solenoid control signal is outputted so that the actual fuel pressure calculated in the fuel pressure input processing means 701 becomes the target fuel pressure calculated in the target fuel pressure calculating means 702. FIG. 14 shows one example of the reference REF generation method. There is a dropout portion (portion where the interval is larger than the interval of the ordinary crank angle sensor signal) in the crank angle sensor signal. The crank angle sensor value from the time of start of the engine to the time of initial dropout recognition is set as a reference REF, and the reference REF is generated from the crank angle sensor value at each fixed angle thereafter. Dropout recognition is determined according to the crank angle sensor input interval.

In the case that the plunger phase is not settled during the B control, and the REF signal cannot be generated, or the like, condition 2 is established, and the control transitions to the A control.

Further, when the starter switch is turned on, the engine 507 is brought into the cranking state, and the fuel pressure in the common rail 53 is low, pressure rising is promoted by carrying out the A control, whereas when the pump reference REF is generated, and the target fuel pressure and the fuel pressure in the common rail are likely to be converged, condition 4 is established, and the control transitions to the F/B control block 1404.

Thereafter, the F/B control block 1404 is continued as long as the engine does not stall. However, in the aforesaid F/B control block 1404, when fuel cut by deceleration or the like of the vehicle occurs, and the pressure reduction requirement is absent, condition 5 is established, the control transitions to a discharge prohibition control block 1405, the pump state variable: PUMPMD=3 is set, and pressurized feeding of the fuel to the common rail 53 from the high pressure fuel pump 1 is stopped.

From the aforesaid discharge prohibition control block 1405, the control transitions to the F/B control block 1404 when condition 6 is established by termination of fuel cut, and returns to the aforesaid ordinary feedback control, whereas when a pressure reduction requirement occurs, condition 10 is established, the control transitions to a pressure reduction control block 1406, the pump state variable: PUMPMD=4 is set, and the pressure reduction control is started.

In the F/B control block 1404, when fuel cut due to deceleration or the like of the vehicle occurs, and a pressure reduction requirement is present, condition 8 is established, and the control transitions to the pressure reduction control block 1406, whereas when the fuel cut is canceled, condition 9 is established and the control transitions to the F/B control block 1404. When a pressure reduction requirement is absent during fuel cut in the block 1406, condition 11 is established, and the control transitions to the block 1405.

When the aforesaid control unit 515 recognizes engine stalling during the F/B control, the discharge prohibition control or the pressure reduction control, condition 7 is established, and the control transitions to the A control block 1402.

Figure 15:
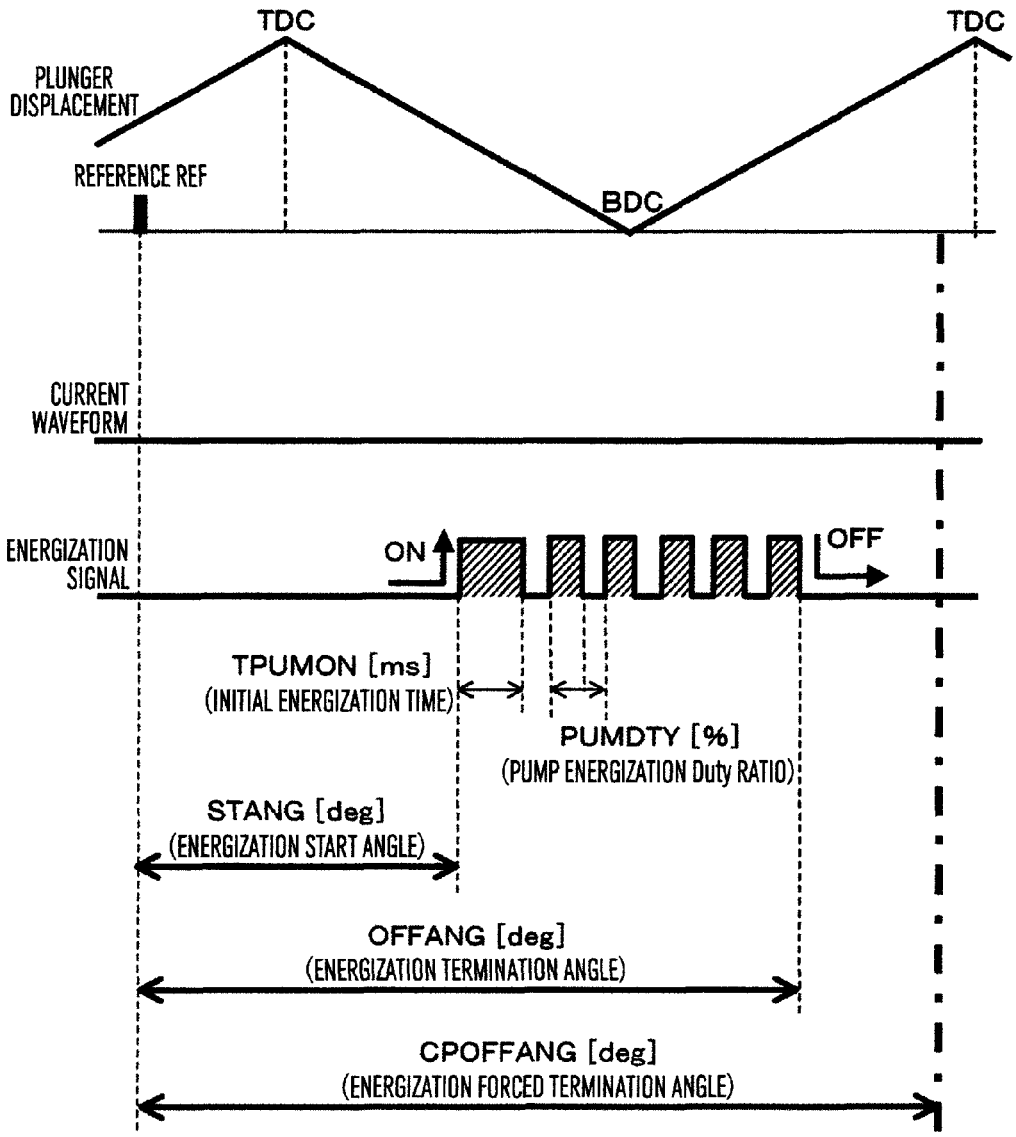
FIG. 15 is a pump control time chart according to the internal combustion engine control system of FIG. 1.

FIG. 15 shows a time chart of an energization signal to the solenoid 200 during the F/B control and the pressure reduction control. From the energization start angle STANG to the energization termination angle OFFANG an open current control duty is outputted. The aforesaid open current control duty is configured by an initial energization time TPUMON and the duty after the initial energization. Here, the initial energization time TPUMON and a duty ratio PUMDTY after the initial energization are calculated in the pump control DUTY calculating means 704.

Figure 16:
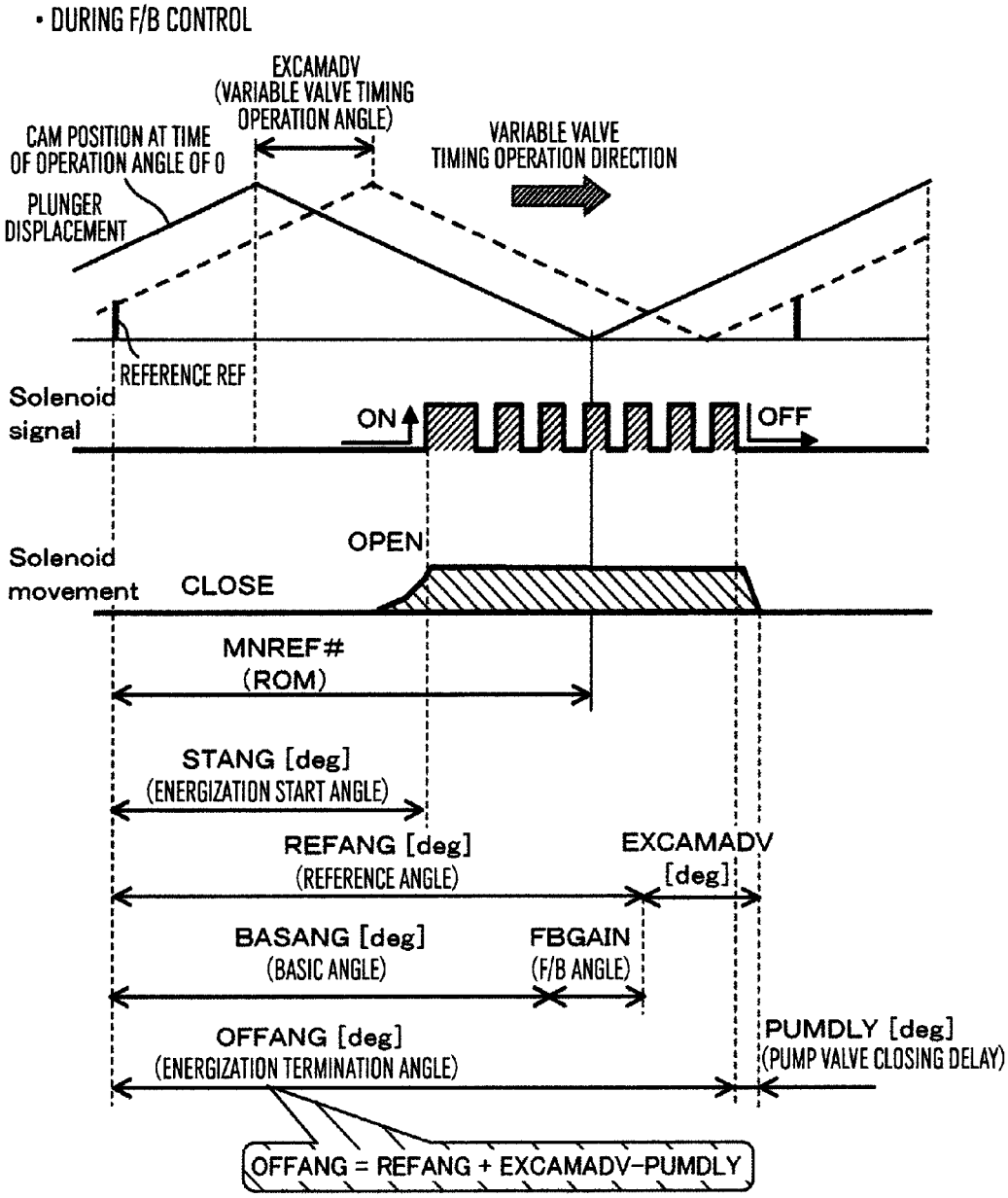
FIG. 16 is a pump control time chart according to the internal combustion engine control system of FIG. 1.

FIG. 16 shows respective parameters which are used for the energization start angle STANG and the energization termination angle OFFANG of the solenoid control signal for control of the fuel pressure by the aforesaid control unit 515 during the F/B control.

The energization start angle STANG and the energization termination angle OFFANG of the aforesaid solenoid signal are set on the basis of the reference REF which is generated based on the CRANK signal and the CAM signal, and of the stroke of the plunger 2, and the aforesaid energization start angle STANG is firstly calculated by making correction of the phase difference due to the variable valve timing mechanism of the aforesaid pump drive camshaft for the value of the map to which the engine speed and the battery voltage are inputted as illustrated in FIG. 9.

Further, the aforesaid energization termination angle OFFANG can be obtained as following expression 1.

$$\text{OFFANG}=\text{REFANG}+\text{EXCAMADV}-\text{PUMDLY} \quad \text{(expression 1)}$$

Here, REFANG represents a reference angle, and can be obtained as following expression 2.

$$\text{REFANG}=\text{BASANG}+\text{FBGAIN} \quad \text{(expression 2)}$$

Here, BASANG represents a basic angle, and is calculated with the basic angle map 1101 (FIG. 11) based on the operating state of the engine 507. EXCAMADV represents a cam operation angle, and corresponds to the operation angle of the variable valve timing. PUMDLY represents a pump delay angle, and FBGAIN represents a feedback amount.

FIG. 16 shows respective parameters used for the energization start angle STANG and the energization termination angle OFFANG of the solenoid control signal for control of the fuel pressure by the aforesaid control unit 515 during the F/B control.

The energization start angle STANG and the energization termination angle OFFANG of the aforesaid solenoid signal are set on the basis of the reference REF which is generated based on the CRANK signal and the CAM signal, and of the stroke of the plunger 2, and the aforesaid energization start angle STANG is firstly calculated by making correction of the phase difference due to the variable valve timing mechanism of the aforesaid pump drive camshaft for the value of the map to which the engine speed and the battery voltage are inputted as illustrated in FIG. 9.

Further, the aforesaid energization termination angle OFFANG can be obtained as following expression 1

$$\text{OFFANG}=\text{REFANG}+\text{EXCAMADV}-\text{PUMDLY} \quad \text{(expression 1)}$$

Here, REFANG represents a reference angle, and can be obtained as following expression 2.

$$\text{REFANG}=\text{BASANG}+\text{FBGAIN} \quad \text{(expression 2)}$$

Here, BASANG represents a basic angle, and is calculated with the basic angle map 1101 (FIG. 11) based on the operating state of the engine 507. EXCAMADV represents a cam operation angle, and corresponds to the operation angle of the variable valve timing. PUMDLY represents a pump delay angle, and FBGAIN represents a feedback amount.

Figure 17:
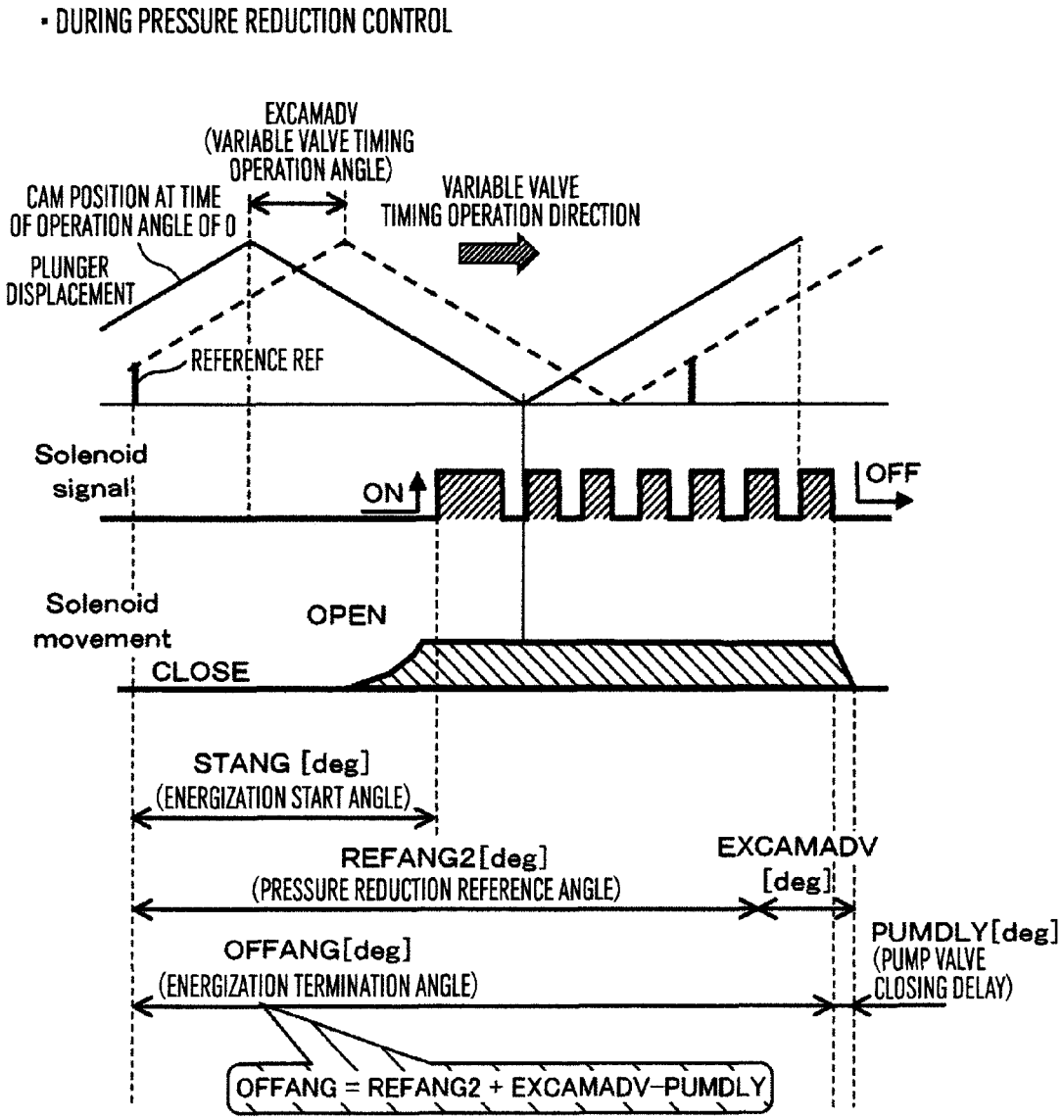
FIG. 17 is a control time chart of the present invention according to the internal combustion engine control system of FIG. 1.
Figure 18A:
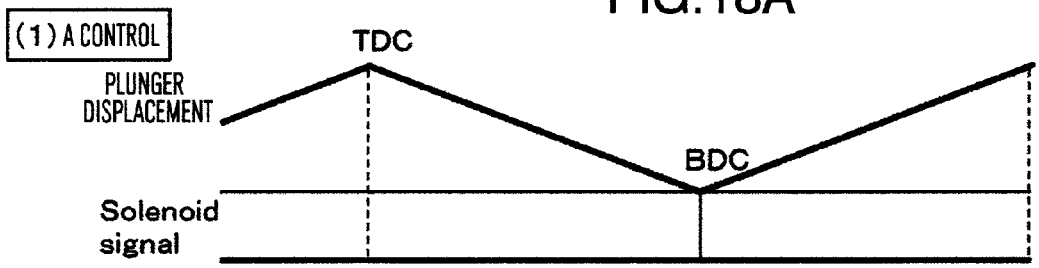
FIGS. 18A-D are control time charts of the present invention according to the internal combustion engine control system of FIG. 1.
Figure 18B:
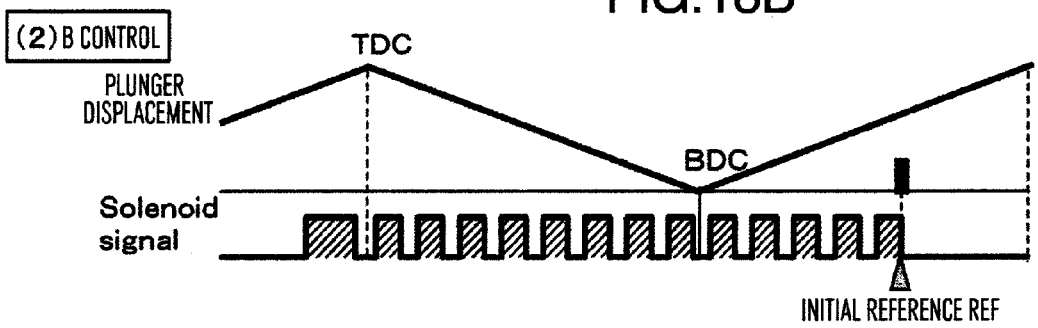
Figure 18C:
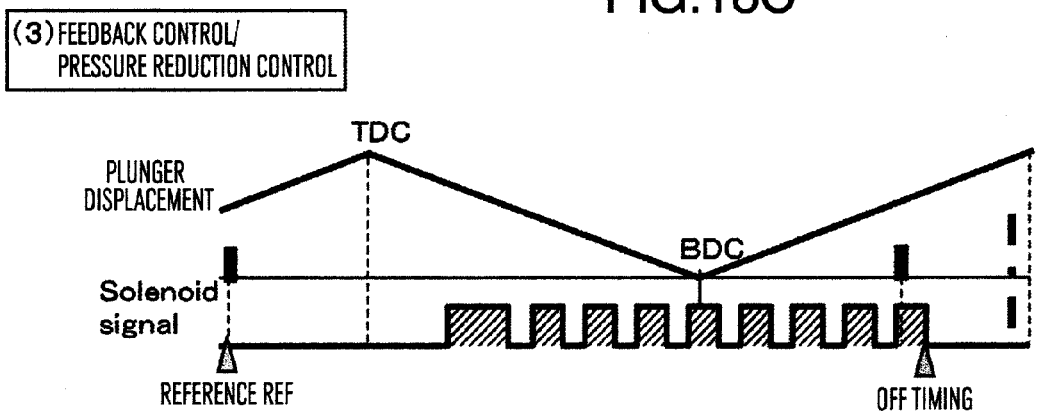
Figure 18D:
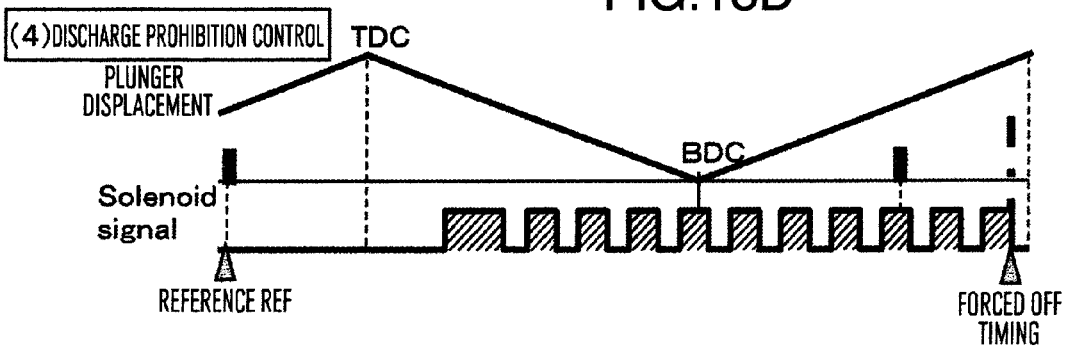

FIG. 17 shows respective parameters which are used for the energization start angle STANG and the energization termination angle OFFANG of the solenoid control signal for the control of the fuel pressure by the aforesaid control unit 515 during pressure reduction control.

In the same manner with the F/B control, the reference REF, the energization start angle STANG and the energization termination angle OFFANG are set, and the OFFANG can be obtained as following expression 3.

$$\text{OFFANG}=\text{REFANG2}+\text{EXCAMADV}-\text{PUMDLY} \quad \text{(expression 3)}$$

Here, the REFANG2 represents the reference angle, and is calculated by the block 1107 in FIG. 11.

FIGS. 18A-D show energization signals to the solenoid 200 in the respective control states. During the A control, energization is not carried out for the solenoid 200. During the B control, the aforesaid open current control duty is outputted until a first reference REF from the B control permission time. During the F/B control and during the pressure reduction control, the aforesaid open current control duty is outputted until the aforesaid energization termination angle OFFANG from the aforesaid energization start angle STANG. During the discharge prohibition control, the open current control duty is outputted until the aforesaid energization forced termination angle CPOFFANG from the aforesaid energization start angle STANG.

As above, the aforesaid embodiment of the present invention provides the following functions by the above described configuration.

The control unit 515 of the aforesaid embodiment is the high pressure fuel pump control system for the in-cylinder injection engine 507 which has the injector 54 included in the cylinder 507*b*, the high pressure fuel pump 1 for feeding the fuel by pressure to the aforesaid injector 54, the common rail 53 and the fuel pressure sensor 56, and when a pressure reduction requirement occurs, the control system utilizes the fuel backflow region due to closing delay of the discharge valve of the high pressure fuel pump, controls the high pressure pump actuator so as to return the fuel in the common rail into the high pressure pump, reduces the fuel pressure to a target fuel pressure, and thereby, can enhance fuel efficiency, stabilize combustion and improve emission gas performance.

Figure 21A:
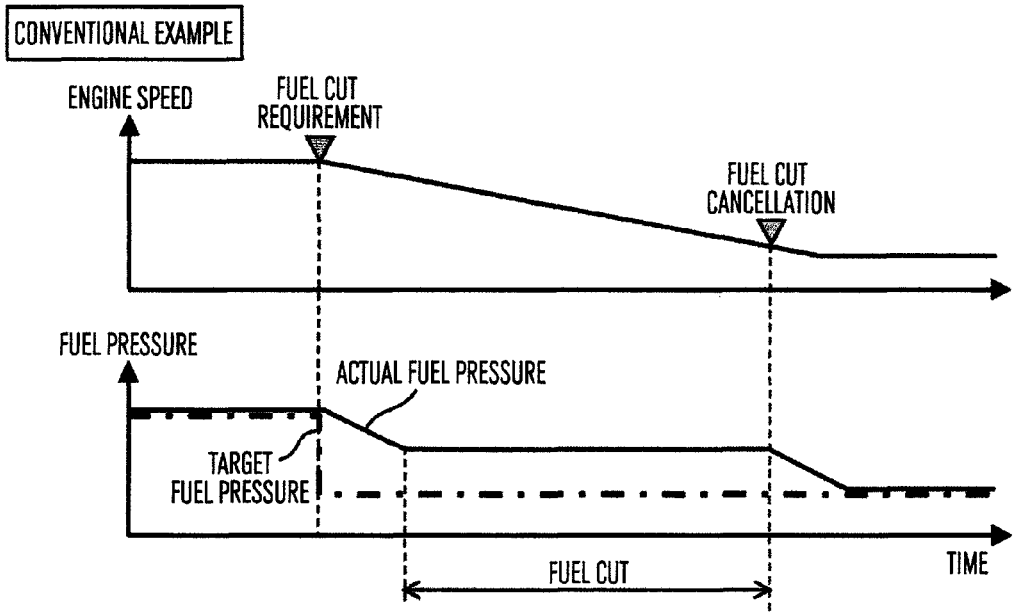
Figure 21B:
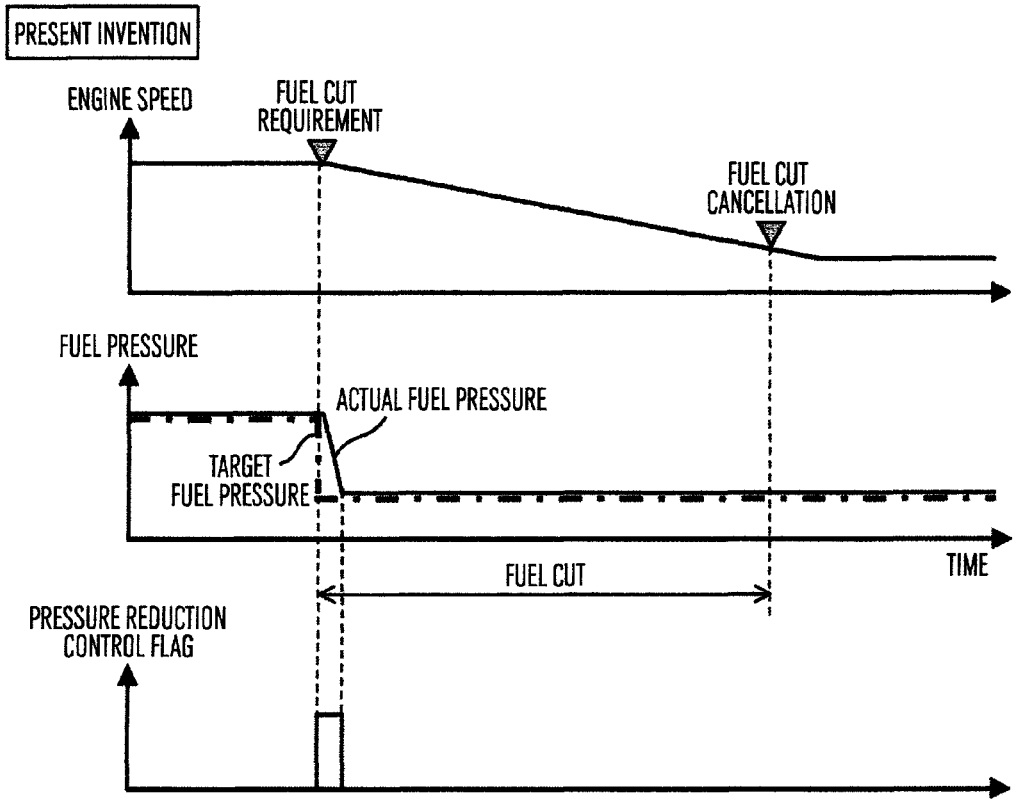

One example of an effect of the present invention will be described based on FIGS. 21A-B. FIGS. 21A-B show time charts of the control system in the case of the present invention, and the conventional art. In the conventional art, the fuel cut timing is delayed in order to reduce the fuel pressure at the time of fuel cut requirement, which causes reduction in fuel efficiency. Further, at the time of cancelling the fuel cut, the difference from the target fuel pressure occurs, and the emission gas performance is likely to be worsened.

In the present invention, the fuel can be cut from the time of fuel cut requirement, and the fuel can be injected at the target fuel pressure at the time of cancelling the fuel cut. From the above configuration, the fuel efficiency of the internal combustion engine is enhanced, and enhancement of the operation performance and improvement of the emission gas performance by stabilization of combustion can be realized.

Although the foregoing description has been made on embodiments of the invention, the invention is not limited thereto and various changes and modifications of design may be made without departing from the spirit of the invention recited in the appended claims. In particular, the present embodiment is described by illustrating the normal closed type pump which opens the valve in the state where the drive current is passed as an example, but the present embodiment may be the control system using the normal open type pump having the intake valve of the structure which opens in the state where the drive current is not passed. More specifically, the present invention can be carried out in any type of high pressure pump which takes the fuel into the pressurized chamber by opening the intake valve, pressurizes the fuel in the pressurized chamber by closing the intake valve, and discharges the fuel from the discharge valve.

As is understood from the above description, the high pressure fuel pump control system according to the present embodiment can realize the target fuel pressure without sacrificing the fuel cut requirement time, and therefore, can contribute to enhancement in fuel efficiency, enhancement in operation performance and improvement of the emission gas performance by stabilization of combustion.

The invention claimed is:

1. A high pressure fuel pump control system which takes fuel into a pressurized chamber by descent of a plunger, pressurizes the fuel in the pressurized chamber by closing an intake valve at a desired timing during ascent of the plunger, and discharges the fuel into a common rail from a discharge valve comprising a check valve, wherein when a pressure reduction requirement is made, the control system reduces pressure in the common rail by closing the intake valve at a timing when a backflow amount which flows back through the discharge valve from the common rail to the pressurized chamber becomes larger than a discharge amount which is discharged from the discharge valve.

2. The high pressure fuel pump control system for an internal combustion engine according to claim 1, wherein a valve opening phase of the discharge valve is calculated by using at least one of the pressure in the common rail, an engine speed, and target pressure in the common rail.

3. The high pressure fuel pump control system for an internal combustion engine according to claim 1, wherein the timing of closing the intake valve starts from a timing when the high pressure fuel pump becomes in a non-discharging state, and is retrieved so that the timing becomes a timing when the backflow amount which flows back through the discharge valve from the common rail to the pressurized chamber becomes larger than the discharge amount discharged from the discharge valve.

4. The high pressure fuel pump control system for an internal combustion engine according to claim 1, wherein the pressure reduction requirement is calculated by using at least one of the pressure in the common rail and target pressure.

5. The high pressure fuel pump control system for an internal combustion engine according to claim 1, wherein by using at least one of the pressure in the common rail and target pressure, the control system switches a state to any one of a state where the fuel in the common rail is returned to the pump pressurized chamber during fuel cut of the internal combustion engine, a high pressure fuel pump non-discharging state, and a high pressure fuel pump discharging state.

6. A high pressure fuel pump control system which takes fuel into a pressurized chamber by descent of a plunger, pressurizes the fuel in the pressurized chamber by closing an intake valve at a desired timing during ascent of the plunger, and discharges the fuel into a common rail from a discharge valve comprising a check valve, wherein during fuel cut, the control system reduces pressure in the common rail by closing the intake valve at a timing when a backflow amount which flows back through the discharge valve from the common rail to the pressurized chamber becomes larger than a discharge amount which is discharged from the discharge valve, so that the pressure in a common rail becomes target fuel pressure after return from the fuel cut.

* * * * *